US009091262B2

(12) United States Patent
Runkle

(10) Patent No.: US 9,091,262 B2
(45) **Date of Patent: *Jul. 28, 2015**

(54) USE OF WATTMETER TO OBTAIN DIAGNOSTICS OF HYDRAULIC SYSTEM DURING TRANSIENT-STATE START-UP OPERATION

(75) Inventor: Mark Andrew Runkle, Schenectady, NY (US)

(73) Assignee: General Electric Company, Schenectady, NY (US)

( * ) Notice: Subject to any disclaimer, the term of this patent is extended or adjusted under 35 U.S.C. 154(b) by 1091 days.

This patent is subject to a terminal disclaimer.

(21) Appl. No.: 13/117,290

(22) Filed: May 27, 2011

(65) Prior Publication Data

US 2012/0301322 A1 Nov. 29, 2012

(51) Int. Cl.

| | |
|---|---|
| ***F04B 49/06*** | (2006.01) |
| ***F15B 1/02*** | (2006.01) |
| ***F04B 49/00*** | (2006.01) |

(52) U.S. Cl.

CPC ..... *F04B 49/06* (2013.01); *F04B 49/002* (2013.01); *F04B 49/065* (2013.01); *F15B 1/02* (2013.01); *F04B 2203/0208* (2013.01); *F15B 2201/50* (2013.01)

(58) Field of Classification Search

CPC ..... G01R 21/00; G01R 22/00; F15B 1/02; F15B 2201/50; F15B 2201/51; F04B 49/065; F04B 2203/0208; F04B 2205/00; F04B 49/002; F04B 49/06

USPC ..... 417/44.1, 36, 45; 702/183, 60, 61

See application file for complete search history.

(56) References Cited

U.S. PATENT DOCUMENTS

| | | | | |
|---|---|---|---|---|
| 4,108,574 | A | 8/1978 | Bartley et al. | |
| 4,278,403 | A * | 7/1981 | Shafer | 417/38 |
| 5,318,409 | A | 6/1994 | London et al. | |
| 5,353,646 | A | 10/1994 | Kolpak | |
| 5,865,602 | A | 2/1999 | Nozari | |
| 5,944,159 | A * | 8/1999 | Schneider et al. | 192/85.63 |
| 8,812,264 | B2 * | 8/2014 | Runkle | 702/183 |
| 2002/0170349 | A1 | 11/2002 | Soneda et al. | |

(Continued)

FOREIGN PATENT DOCUMENTS

| | | | |
|---|---|---|---|
| GB | 2313197 | A | 11/1997 |
| WO | WO 0162532 | A1 * | 8/2001 |

(Continued)

OTHER PUBLICATIONS

Zhang, Notice of Allowance and Fee(s) Due for U.S. Appl. No. 13/069,902 dated Mar. 18, 2014, (GEEN-2012), 7 pages.

(Continued)

*Primary Examiner* — Devon Kramer
*Assistant Examiner* — Nathan Zollinger
(74) *Attorney, Agent, or Firm* — Ernest G. Cusick; Hoffman Warnick LLC

(57) ABSTRACT

Disclosed herein is an approach that uses a wattmeter to obtain diagnostics of a hydraulic system during transient-state start-up operation. In one aspect, a controller uses the electric power measured by the wattmeter during the transient-state start-up operation to determine fluid flow parameters. In another aspect, the controller determines diagnostics for the hydraulic fluid consuming device and the hydraulic pump unit as a function of the fluid flow parameters.

24 Claims, 15 Drawing Sheets

(56) References Cited

U.S. PATENT DOCUMENTS

| | | | | |
|---|---|---|---|---|
| 2004/0064292 | A1 | 4/2004 | Beck et al. | |
| 2005/0207898 | A1 | 9/2005 | Lee | |
| 2008/0256918 | A1* | 10/2008 | Kubinski | 56/17.1 |
| 2009/0204245 | A1 | 8/2009 | Sustaeta et al. | |
| 2009/0260912 | A1 | 10/2009 | Isogai | |
| 2010/0156112 | A1* | 6/2010 | Held et al. | 290/1 A |
| 2010/0189572 | A1* | 7/2010 | Hansen | 417/44.1 |
| 2010/0275565 | A1* | 11/2010 | Moe et al. | 56/15.9 |

FOREIGN PATENT DOCUMENTS

| | | | |
|---|---|---|---|
| WO | 03031918 | A1 | 4/2003 |
| WO | 2005026922 | A1 | 3/2005 |
| WO | 2005085772 | A1 | 9/2005 |

OTHER PUBLICATIONS

Zhang, Office Action Communication for U.S. Appl. No. 13/069,902 dated Feb. 26, 2013, (GEEN-0212), 19 pages.

GE Multilin, "469 Motor Management Relay Instruction Manual", Copyright 2008 GE Multilin, 248 pages, 469 Firmware Revision 30E29x.000, 469 PC Software Revision 2.9x, Manual P/N: 1601-0057-DH (GEK-106289J), Canada.

GE Multilin, "469 Motor Management Relay Instruction Manual", Copyright 2009 GE Multilin, 338 pages, Software Revision 5.0x, Manual P/N: 1601-0122-A8 (GEK-106474G), http://www.gedigitalenergy.com/products/manuals/469/469man-a8.pdf on Mar. 30, 2010, Canada.

GE Digital Energy Protection & Control, "469 Motor Protection System Complete Integration Protection and Management of Medium and Large Motors," 2010 General Electric Company, 8 pages, retrieved from: http://www.gedigitalenergy.com/multilin/catalog/469.htm on Feb. 9, 2011.

Zhang, Office Action Communication for U.S. Appl. No. 13/069,902 dated Jul. 26, 2013, (GEEN-0212), 19 pages.

European Patent Office, European Search Report for Application No. 12160038.1 dated Jun. 2, 2014, 9 pages.

* cited by examiner

USE OF WATTMETER TO OBTAIN DIAGNOSTICS OF HYDRAULIC SYSTEM DURING TRANSIENT-STATE START-UP OPERATION

BACKGROUND OF THE INVENTION

The present invention relates generally to hydraulic systems, and more particularly to using a wattmeter in conjunction with a hydraulic pump unit to obtain electric power measurements for use by a controller to determine fluid flow parameters during a transient-state start-up operation and diagnostics derived therefrom.

Hydraulic systems such as hydraulic pump units are used in a wide range of applications. Fluid power supplies for hydraulic rams, hydraulically actuated valves and lift oil systems are a few examples in which hydraulic pump units are deployed. A typical hydraulic pump unit includes a motor driven pump that supplies pressurized hydraulic fluid from a tank to actuators via a control valve. Because a typical hydraulic pump unit can transmit high forces of highly pressurized hydraulic fluid it is often difficult to find flow instruments with a long life. Without accurate flow rate readings, the ability for determining hydraulic fluid parameters and performing diagnostics on these hydraulic pump units is impaired.

BRIEF DESCRIPTION OF THE INVENTION

In one aspect of the present invention, a system is provided. The system comprises a hydraulic fluid consuming device; a hydraulic pump unit that provides hydraulic fluid to the hydraulic fluid consuming device, the hydraulic pump unit including a pump unit and at least one accumulator that are configured to deliver the hydraulic fluid to the hydraulic fluid consuming device; a wattmeter that measures the electric power consumption by the hydraulic pump unit during a transient-state start-up operation in which the hydraulic pump unit turns on to deliver the hydraulic fluid to the hydraulic fluid consuming device for a predetermined amount of time; and a controller that uses the electric power measured by the wattmeter during the transient-state start-up operation to determine fluid flow parameters from the operation of the pump unit and the at the least one accumulator, wherein the controller determines a plurality of diagnostics for the hydraulic fluid consuming device and the hydraulic pump unit as a function of the fluid flow parameters.

In another aspect of the present invention, a hydraulic system is provided. The hydraulic system comprises a plurality of hydraulic fluid consuming devices; an electric motor; a pump unit driven by the electric motor that provides hydraulic fluid to the plurality of hydraulic fluid consuming devices, the pump unit further including at least one accumulator used to contribute in delivering the hydraulic fluid to the hydraulic fluid consuming devices; a valve that controls supply of the hydraulic fluid by the pump unit and the at least one accumulator to the plurality of hydraulic fluid consuming devices; a wattmeter that measures the electric power consumption by the electric motor as the pump unit and the at least one accumulator provide the hydraulic fluid to the plurality of hydraulic fluid consuming devices during a transient-state start-up operation in which the pump unit and the at least one accumulator turn on to deliver the hydraulic fluid to the plurality of hydraulic fluid consuming devices for a predetermined amount of time; and a controller that uses the electric power measured by the wattmeter during the transient-state start-up operation to determine fluid flow parameters from the operation of the pump unit and the at the least one accumulator, wherein the controller determines a plurality of diagnostics for the hydraulic fluid consuming device and the hydraulic pump unit as a function of the fluid flow parameters.

DETAILED DESCRIPTION OF THE INVENTION

Various embodiments of the present invention are directed to using a wattmeter in conjunction with a hydraulic pump unit to obtain electric power measurements for a hydraulic system during a transient-state start-up operation. The electric power measurements are used by a controller to determine hydraulic fluid flow parameters for the hydraulic system. These hydraulic fluid flow parameters can be used to obtain diagnostics on the hydraulic pump unit and a hydraulic fluid consuming device connected to the pump unit. An example of a transient-state start-up operation comprises stroking at least one hydraulic fluid consuming device from a closed position where the delivery of hydraulic fluid is inhibited to an open position where a substantial amount of hydraulic fluid is provided by a pump unit and an accumulator, and back to the closed position where the delivery of hydraulic fluid to the hydraulic fluid consuming device is inhibited.

Examples of hydraulic fluid flow parameters that may be determined from the wattmeter's electric power measurements include the power delivered to the hydraulic fluid by the hydraulic pump unit and volumetric flow rate of the hydraulic fluid delivered to the hydraulic fluid consuming device. Examples of diagnostics that may be obtained from the hydraulic fluid parameters include determining an amount of energy used by the accumulator during the stroking of the hydraulic fluid consuming device, determining an amount of hydraulic fluid displaced during the stroking of the hydraulic fluid consuming device, using the amount of displaced hydraulic fluid as a marker to compare against subsequent measurements of displaced hydraulic fluid obtained from future stroking of the hydraulic fluid consuming device, and determining slew time to perform the stroking of the hydraulic fluid consuming device.

Technical effects of the various embodiments of the present invention include improved diagnostics of a hydraulic pump unit including the accumulator(s) and a hydraulic fluid consuming device. Such diagnostics can be facilitated remotely via a computing system (e.g., a host controller) located at a distance from the hydraulic pump unit and the hydraulic fluid consuming device, or the diagnostics can be facilitated by a portable human interface machine device operated by a plant operator located in proximity to the pump unit and fluid consuming device. Improved diagnostics reduce troubleshooting time and increase the availability of the hydraulic pump unit and the hydraulic fluid consuming device for operation in performing prescribed process operations.

Figure 1:
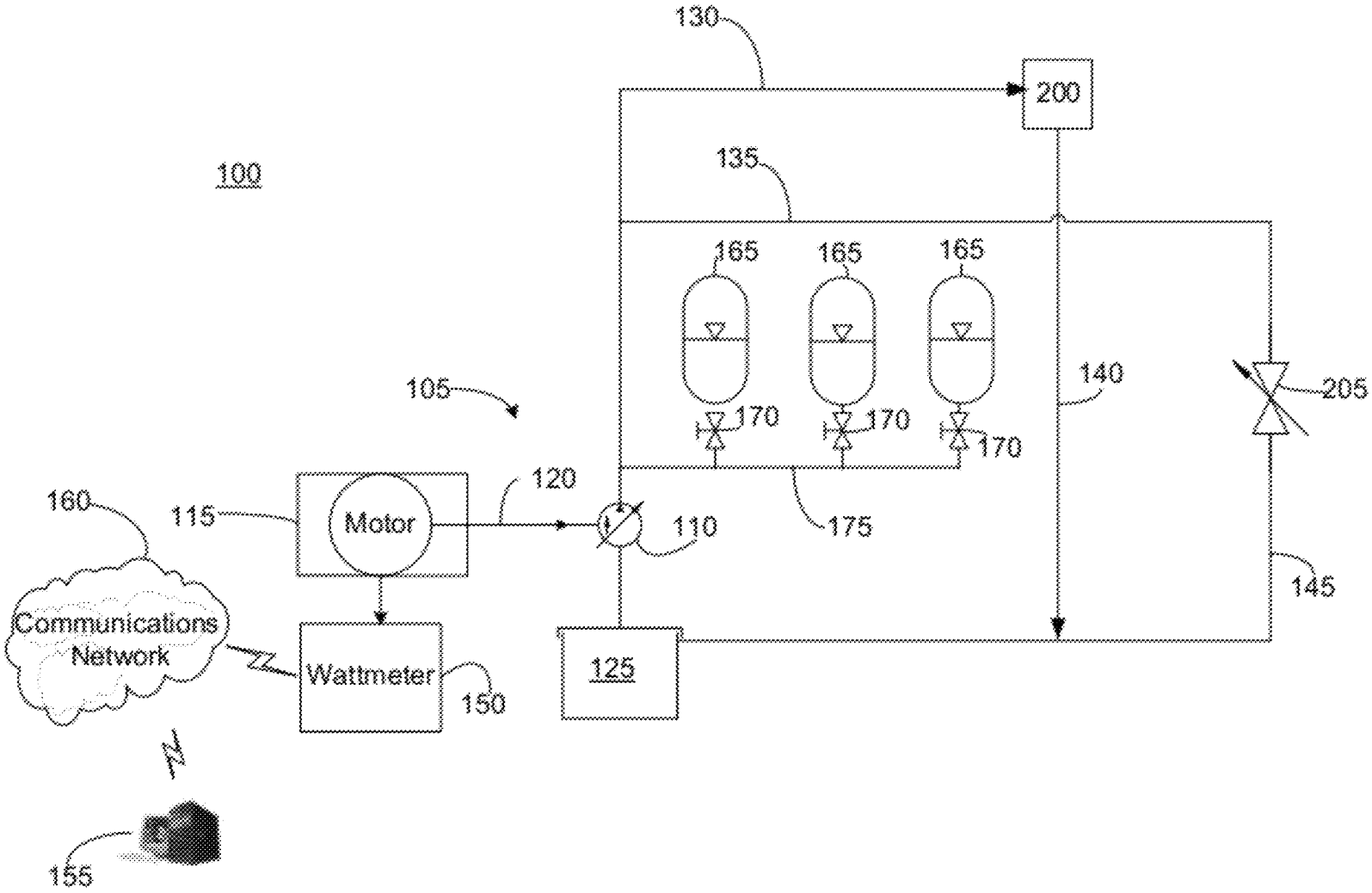
FIG. 1 is a schematic diagram illustrating a hydraulic system according to one embodiment of the present invention.

Referring to the drawings, FIG. 1 is a schematic diagram illustrating a hydraulic system 100 according to one embodiment of the present invention. Hydraulic system 100 includes a hydraulic pump unit 105 that includes a pump unit 110 driven by an electric motor 115 along a load coupling 120. A tank 125 contains hydraulic fluid that pump unit 105 extracts and delivers to a hydraulic fluid consuming device 200 and/or to a hydraulic fluid consuming device 205 (represented as a valve in FIG. 1) as pressurized fluid along lines 130 and 135, respectively. Hydraulic pump unit 105 further includes accumulators 165 that can be used to supply the hydraulic fluid to hydraulic fluid consuming device 200 and/or to hydraulic fluid consuming device 205 via valves 170 and lines 175 which couple to lines 130 and 135. Accumulators 165 are located on the pressurized side of pump unit 110 and can be used to store pressurized oil in the event of a momentary loss of pump power, or to provide a high quality of pressure regulation to hydraulic fluid consuming device 200 and/or to hydraulic fluid consuming device 205.

As used herein, hydraulic fluid consuming device 200 is representative of a device that can be controlled by a process controller or a device that can inform the controller that it is consuming hydraulic fluid. The former may be a hydraulic valve controller that opens larger valves by filling hydraulic rams that position valve stems of the large valves. The latter is typically a limit switch on manual valves or a linear variable displacement transformer (LVDT). As used herein, hydraulic fluid consuming device 205 is representative of a device that is not actively controlled by a process controller. However, this does not mean that these hydraulic fluid consuming devices are fixed with time. In one embodiment, hydraulic fluid consuming device 205 may represent laminar flow leakage through actuators, high-pressure packing seals or inadvertent piping leaks.

The hydraulic fluid returns from hydraulic fluid consuming device 200 and/or hydraulic fluid consuming device 205 to tank 125 after use thereof via lines 140 and 145, respectively. Pump unit 105 can be used to resupply accumulators 165 with the hydraulic fluid. For the sake of explaining the various embodiments associated with the present invention, the following description pertains to the delivery of pressurized hydraulic fluid to and from hydraulic fluid consuming device 200.

In one embodiment, hydraulic pump unit 110 may be a swash plate pump having a rotating cylinder containing pistons, where a spring pushes the pistons against a stationary swash plate that sits at an angle to the cylinder. In operation, the pistons suck in fluid during half a revolution and push fluid out during the other half. In one embodiment, as illustrated in FIG. 1, pump unit 105 may be a swash plate pump that is of the variable displacement, self-pressure regulated type. A swash plate pump that is of the variable displacement, self-pressure regulated type has a control arm that controls the angle of the swash plate and thus, operation of the pistons according to a specified pressure set point. The maximum angle setting of the swash plate determines the maximum fluid that can be pumped in one revolution of the pump. The maximum flow rate is thus determined by the maximum angle and the revolutions per minute of the pump as driven by the motor.

In one embodiment, electric motor 115 may be an industrial motor that can take the form of an induction motor such as an alternating current (AC) electric motor. For example, electric motor 115 may be a single-phase motor or a three-phase motor. Electric motor 115 drives the pump unit 110 to a sufficient pressure that facilitates extraction of the hydraulic fluid from tank 125 and delivery to hydraulic fluid consuming device 200 along line 130. As an example, typical pressures for delivery to hydraulic fluid consuming device 200 from pump unit 110 and accumulators 165 may be in the range of about 1600 pound-force per square inch gauge (psig) to about 2400 psig for valve control supplies used with a turbine and about 3300 psig for a bearing lift oil system.

During operation of hydraulic pump unit 105 with hydraulic fluid consuming device 200, a wattmeter 150 measures the electric power consumed by electric motor 115 as pump unit 110 and accumulators 165 provide the hydraulic fluid to hydraulic fluid consuming device 200 along line 130. In one embodiment, for a typical operation including steady-state operations, hydraulic fluid consuming device 200 receives the majority of hydraulic fluid from accumulators 165 as opposed to pump unit 110 because the accumulators are configured to discharge fluid faster than the rate which the pump can supply fluid from tank 125. After a steady-state event has ended, pump unit 110 can be used to recharge the accumulators with hydraulic fluid in order to restore volume equilibrium between pump unit 110 and accumulators 165.

During a start-up transient event or operation, electric motor 115 has just been turned on and is pressurizing accumulators 165 in system 100. Typically, a process controller is programmed to understand that the hydraulic power system is not yet available, and all hydraulic fluid consuming devices (e.g., valves) 200 are not demanding oil. By nature of the slight leakage losses, flow will typically occur at pressure builds through the phenomena represented by the valve 205.

During the steady-state events and the transient-state start-up events, wattmeter 150 transmits the electric power measurements to a controller 155 via a communications network 160. As explained below in more detail, controller 155 may use the electric power measurements from wattmeter 150 to determine fluid flow parameters. For example, controller 155 can determine the power delivered to the hydraulic fluid by pump unit 110 including accumulators 165 and the volumetric flow rate of the hydraulic fluid delivered to hydraulic fluid consuming device 200 by the pump during the steady-state and transient-state start-up events. In addition, as explained below in more detail, controller 155 may determine diagnostics for hydraulic fluid consuming device 200, electric motor 115 and pump unit 105 during steady-state and transient-state start-up operations from these fluid flow parameters.

In one embodiment, wattmeter 150 may be a stand-alone device or it may be integrated within a modern smart motor controller such as a motor protection system (e.g., motor relays, meters, motor control centers, etc.) that is used to protect industrial motors from failing. As is well-known in the art, these motor protection systems generally provide protection against conditions including: unbalanced loads, excessively high overcurrent faults, undervoltage conditions, overvoltage conditions, mechanical jams and load losses. In addition, these motor protection systems can obtain data measurements such as current, voltage, frequency, power and var and transmit them to controller 155 via communications network 160. One example of a commercially available motor protection device that may be integrated with wattmeter 150 is a 369 Motor Management Relay sold by GE Multilin. Those skilled in the art will recognize that there are other commercially available motor protection devices that perform functions and generate information similar to the 369 Motor Management Relay that can be utilized in the embodiments described herein.

In one embodiment, controller 155 may be integrated within a host controller (e.g., host computing system) located at a distance from hydraulic pump unit 105 and hydraulic fluid consuming device 200. In another embodiment, controller 155 may be embedded within a portable human interface machine device that can be used by a plant operator located in proximity to hydraulic pump unit 105 and hydraulic fluid consuming device 200. Regardless of the implementation, controller 155 is able to communicate with all of the elements (i.e., pump unit 110, electric motor 115, tank 125, accumulators 165, hydraulic fluid consuming devices 200 and 205, and wattmeter 150) illustrated in FIG. 1 via communications network 160.

Those skilled in the art will recognize that system 100 is only a schematic and that additional elements may exist, however, for the sake of simplicity in illustrating the various embodiments of the present invention these elements are not illustrated in FIG. 1. For example, those skilled in the art will recognize that hydraulic pump unit 105 may have other elements such as a filters to protect sliding parts from friction and pressure control orifices from blockage, control valves to control the flow of the pressurized hydraulic fluid, manifolds to facilitate delivery of the fluid, sensors and transducers (e.g., current sensors, voltage sensors, temperature sensors), etc. Furthermore, those skilled in the art will recognize that the elements in system 100 may have more components than the amount illustrated in FIG. 1. For example, there may be more than one motor/pump tank set (e.g., a lead prime mover and a lag prime mover) and accompanying wattmeter to deliver the hydraulic fluid. Furthermore, there may be multiple hydraulic fluid consuming devices (e.g., see FIG. 2) that receive the pressurized hydraulic fluid. Furthermore, there may be more or less accumulators 165 deployed in hydraulic system 100 than what is illustrated in FIG. 1.

Figure 2:
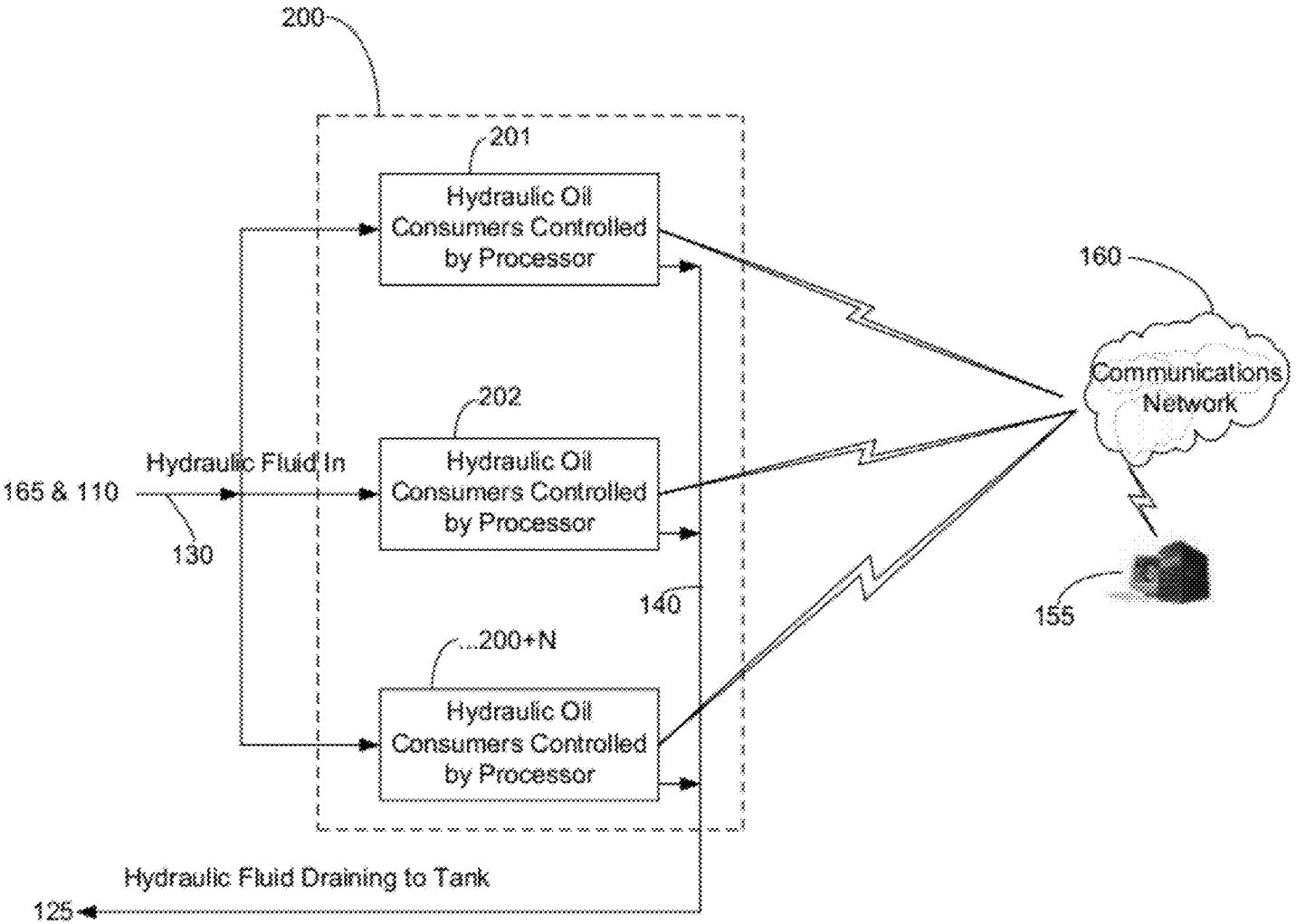
FIG. 2 is a more detailed view of a plurality of hydraulic fluid consuming devices in communication with a controller depicted in FIG. 1 according to one embodiment of the present invention.

FIG. 2 is a more detailed view of a plurality of hydraulic fluid consuming devices in communication with controller 155 via communications network 160. As shown in FIG. 2, hydraulic fluid consuming device 200 which is depicted in FIG. 1 as one element, includes N hydraulic fluid consuming devices (i.e., 201, 202, . . . N). As mentioned above, hydraulic fluid consuming device 200 can be a device that is controlled by a process controller or a device that can inform the controller that it is consuming hydraulic fluid. In the embodiment described with respect to FIGS. 2-3, hydraulic fluid consuming devices 200 are positioning actuators for control valves. As explained below with respect to FIG. 3, these positioning actuators use high-pressure oil (i.e., the pressurized hydraulic fluid) extracted from accumulators 165 and tank 125 by pump unit 110 to fill a right-circular hydraulic cylinder containing an actuator rod. This rod drives the stem of a valve to open and close it for control of a process fluid. These positioning actuators for control valves have a wide range of uses. Non-limiting examples of uses of these positioning actuators may include: construction equipment, cranes and countless other manufacturing uses. Regardless of the application, the end use of the pressurized hydraulic fluid is to move a ram by displacing it with a volume of the fluid.

As shown in FIG. 2, hydraulic fluid consuming devices 200 can communicate with controller 155 via communications network 160 because they are the type of fluid consuming device that is either controlled by the controller or the type that is able to communicate with the controller to inform it of its consumption of hydraulic fluid. In one embodiment, controller 155 assigns a variable to each hydraulic fluid consuming devices 200 that is indicative of whether the actuator is or is not consuming oil. As used herein, the assigned variable is referred to as a control valve moving (CVM) variable. For the scenario in which controller 155 controls how hydraulic fluid consuming devices 200 consume the hydraulic fluid, the CVM can have a value of 0 or 1. A CVM having a value that is equal to 0 is indicative of an instance where controller 155 commands a hydraulic fluid consuming device to not consume hydraulic fluid, whereas a CVM having a value that is equal to 1 is indicative of an instance where controller 155 commands a fluid consuming device to consume the fluid to move the actuator rod. Applying this nomenclature to FIG. 2, each hydraulic fluid consuming device (actuator) i, where i equals 1, 2, . . . N, is assigned a variable $CVM_i$ provided by controller 155, that is equal to 0 or 1 depending upon whether or not the controller has ordered the fluid consuming device to consume the hydraulic fluid.

Figure 3:
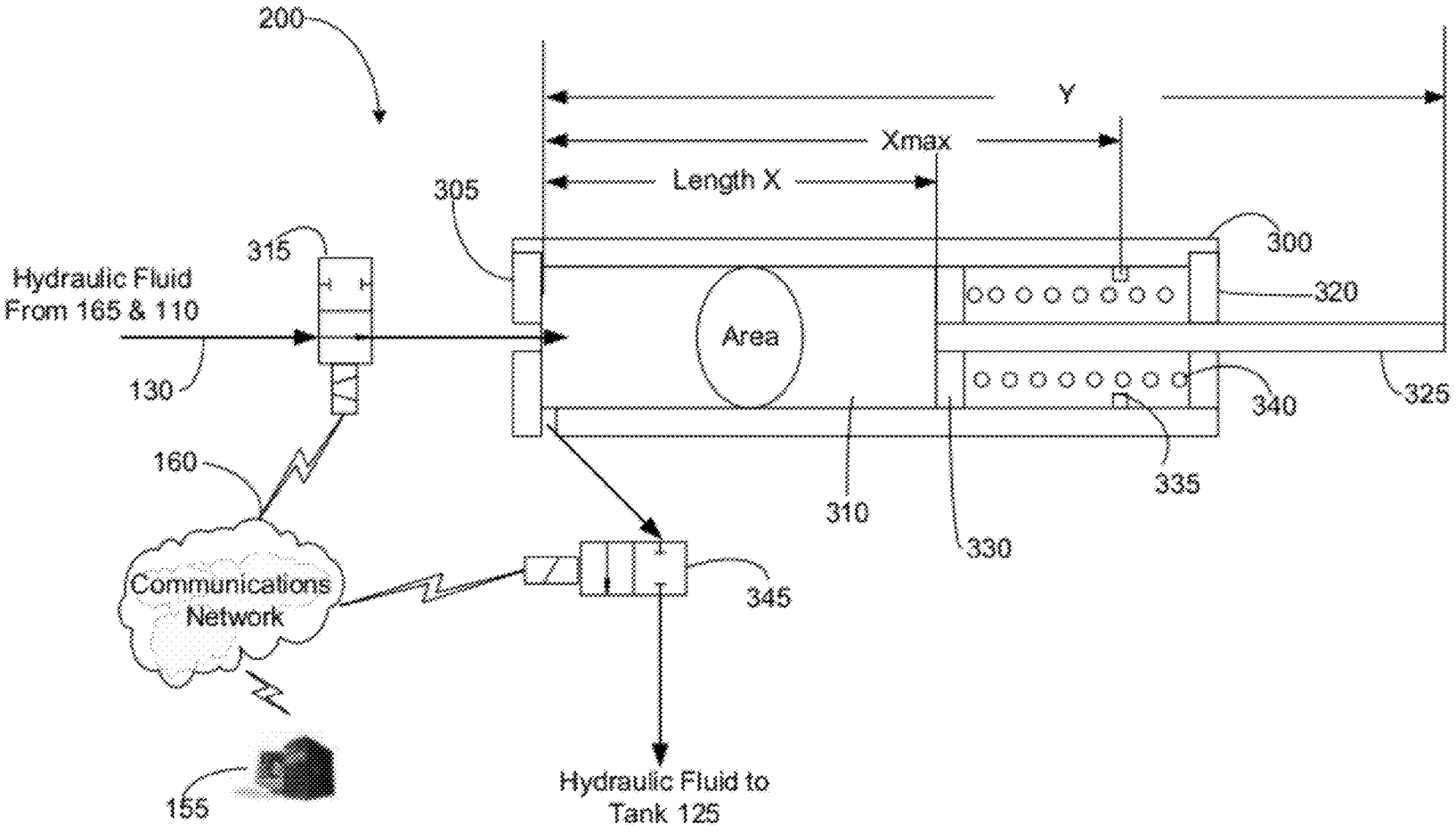
FIG. 3 is a more detailed view of one of the hydraulic fluid consuming devices depicted in FIG. 2 according to one embodiment of the present invention.

FIG. 3 is a more detailed view of one of the hydraulic fluid consuming devices (actuator) 200 depicted in FIG. 2 according to one embodiment of the present invention. As shown in FIG. 3, hydraulic fluid consuming device 200 includes a hydraulic cylinder 300 having a cylinder bottom opening 305 in which the pressurized hydraulic fluid delivered from pump unit 110 can enter a chamber 310 of the cylinder via a control valve 315. Hydraulic cylinder 300 further includes a cylinder head 320 through which a rod 325 having a ram 330 is configured to move within chamber 310 as a function of the displacement of the fluid. In particular, the hydraulic fluid enters cylinder bottom opening 305 in response to control valve 315 permitting the flow of the fluid. Eventually, the hydraulic fluid pressures ram 330 toward cylinder head 320. As shown in FIG. 3, the hydraulic fluid fills an amount in chamber 310 that corresponds to a length X. A limit ring 335 sets the maximum extent of the ram's movement to the right and the maximum length Xmax of hydraulic fluid that can be contained in chamber 310. The position of the rod 325 is represented in FIG. 3 by length Y.

FIG. 3 further shows that hydraulic cylinder 300 further includes a return spring 340 which will drive X to have a length of zero when valve 345 is opened to permit the hydraulic fluid within chamber 310 to empty and return to tank 125. Given this configuration of hydraulic cylinder 300, the volume of the displaced hydraulic fluid is related to the length of ram movement and can be represented by the relationship of:

$$\text{Volume}=\text{Area}\times\text{Length, wherein} \quad (1)$$

Area is the internal area of the hydraulic cylinder 300 and Length is the length that ram 330 is displaced by the fluid.

Based on whether hydraulic cylinder 300 is consuming hydraulic fluid (i.e., using fluid to move ram 330 within chamber 310) or not consuming fluid (i.e., emptying the fluid from chamber 310 into tank 125), controller 155 will assign a CVM variable value of 0 or 1 to valves 315 and 345. In the example illustrated in FIG. 3, since valve 315 is permitting the flow of hydraulic fluid into cylinder bottom opening 305 and valve 345 is closed to prevent the return of the fluid to tank 125, controller 155 assigns a CVM value of 1 to valve 315 and a CVM value of 0 to valve 345.

Referring back to FIG. 1, as accumulator 165 and pump unit 110 delivers the pressurized hydraulic fluid to hydraulic fluid consuming device 200, wattmeter 150 is measuring the electric power consumed by electric motor 115 and transmitting this information to controller 155 via communications network 160. Wattmeter 150 also measures the electric power consumed by electric motor 115 as pump unit 110 recharges or resupplies accumulators 165 with hydraulic fluid in preparation for responding to next operational event. Controller 155 uses the electric power measurements from wattmeter 150 to determine the power delivered to the hydraulic fluid by pump unit 110 and accumulators 165 and the volumetric flow rate of the hydraulic fluid delivered to hydraulic fluid consuming device 200. The determinations of these hydraulic fluid parameters is based on the following equation which describes the relationship for power delivered by a pump to a hydraulic fluid:

$$P\text{fluid}=0.435\times P\text{reg}\times Q, \text{ wherein} \quad (2)$$

Pfluid is the power delivered to the fluid in watts, 0.435 is the conversion factor from psig*gallons/minute to watts, Preg is the regulated pressure across the pump in psig and Q is the volumetric flow rate in gallons per minute (GPM). For the various embodiments of the present invention, it is assumed herein that Preg is constant. As a result, Pfluid, the power delivered to the fluid is proportional to Q, the volumetric flow rate.

In order to determine the power delivered to the fluid (Pfluid), controller 155 may utilize efficiency curves associated with electric motor 115 and pump unit 110. Those skilled in the art will appreciate that the efficiency curves associated with electric motors and pump units are typically provided in the documentation provided by the vendors of these items. Note that pump efficiency is typically assumed to be the constant volumetric efficiency of the pump. In the embodiments of the present invention, efficiency curves associated with electric motor 115 and pump unit 110 may be electronically stored (e.g., in a look-up table) and retrieved by controller 155. As a result of having access to the efficiency curves associated with electric motor 115 and pump unit 110, controller 155 is able determine mechanical power from the electric power measurements provided by wattmeter 150 and fluid power (Pfluid) from mechanical power. Controller 155 can then determine the volumetric flow rate (Q) from the fluid power (Pfluid). The above determinations are represented by the following equations:

$$P\text{mech}=P\text{elec}*\eta_m(P\text{elec}), \text{ wherein} \quad (3)$$

Pmech is the estimated mechanical power in watts, Pelec is the motor power reading from the wattmeter in watts, and $\eta_m$ is the motor efficiency as a decimal, and $$P\text{fluid}=P\text{mech}*\eta_p, \text{ wherein} \quad (4)$$

$\eta_p$ is the pump volumetric efficiency.

Using basic algebra with equation 2, equation 3 and equation 4 results in the following relationship:

$$Q=P\text{elec}*\eta_m(P\text{elec})*\eta_p/(0.435*P\text{reg}) \quad (5)$$

As result, a linear, proportional relationship now exists between measured electric power from wattmeter 150 and volumetric flow rate of the hydraulic fluid delivered to hydraulic fluid consuming device 200.

Figure 4:
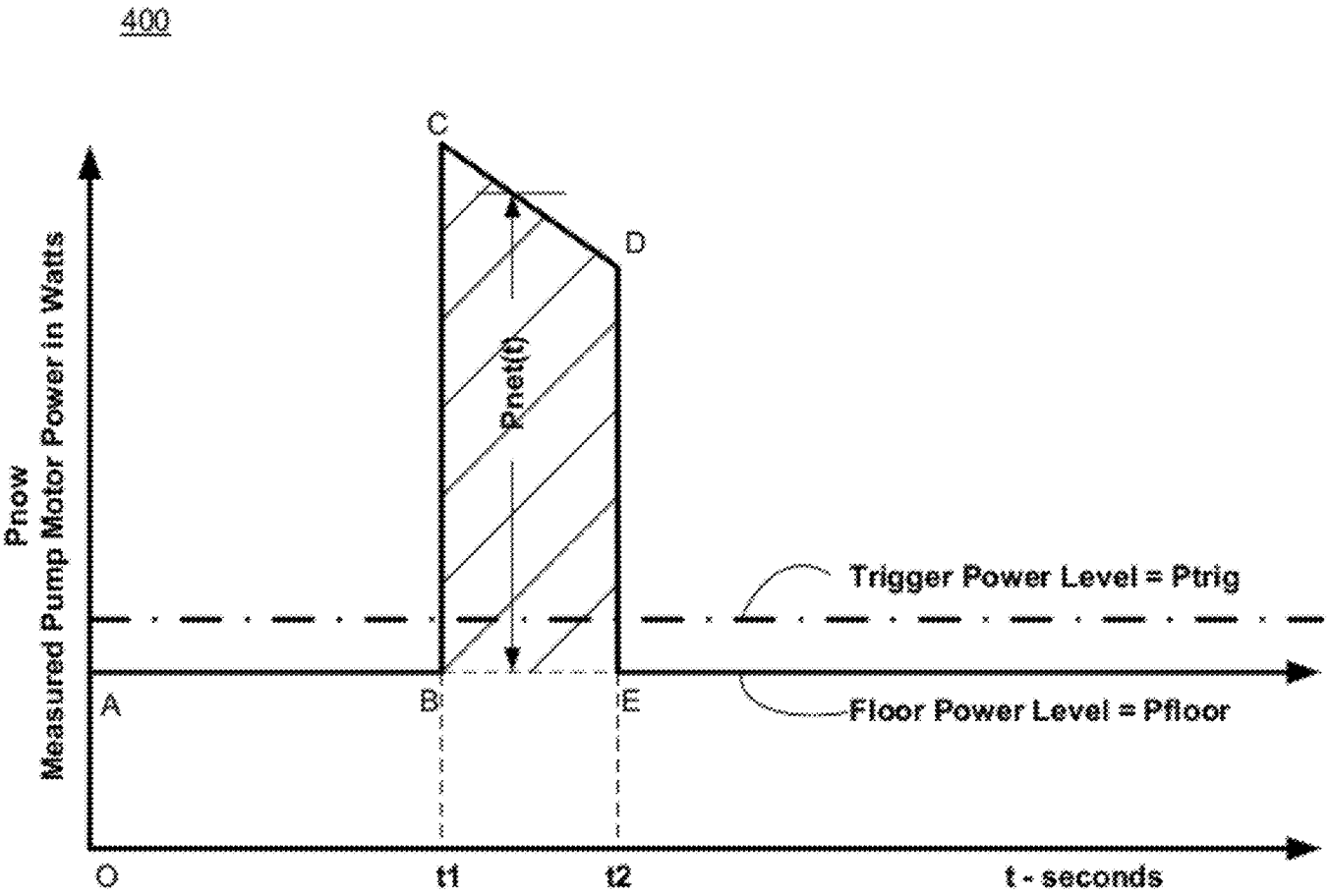
FIG. 4. is a graph illustrating the determination of the volumetric flow rate of hydraulic fluid delivered to a hydraulic fluid consuming device from an instantaneous power measurement according to one embodiment of the present invention.

With equations 1-5, controller 155 is able to ascertain the power delivered to the hydraulic fluid by pump unit 110 and accumulator 165 and the volumetric flow rate of the hydraulic fluid delivered to hydraulic fluid consuming device 200 from power measurements obtained by wattmeter 150. FIG. 4 illustrates the timing of the power measurements with respect to certain events experienced by hydraulic fluid consuming device 200 that are indicative of states when the device is consuming fluid during a steady-state operation or a transient-state start-up operation and states when the device is not consuming fluid. In particular, FIG. 4. is a graph 400 showing a typical power curve versus time for power measurements obtained from wattmeter 150 as hydraulic fluid consuming device 200 is consuming fluid and not consuming fluid. As shown in FIG. 4, the y-axis represents the instantaneous power readings, Pnow, in watts generated from wattmeter 150 and the x-axis represents the time in seconds. The floor power level, Pfloor, represents the flow level where the power draw from pump unit 110 is at a minimum. When the instantaneous power reading, Pnow, is at the floor power level, Pfloor, then this is an indication that hydraulic fluid consuming device 200 is not consuming fluid. As a result, controller 155 assigns hydraulic fluid consuming device 200 a CVM variable value of 0. Those skilled in the art will appreciate that there are various statistical methods of establishing a floor reading for Pfloor. One example of establishing a floor reading for Pfloor is by taking the average value of the power measurements over a period of time that all of the CVMi variables are equal to 0.

A trigger power level, Ptrig, is also shown in graph 400 of FIG. 4. The trigger power level, Ptrig, defines the minimum power draw greater than Pfloor that is representative of the occurrence of a steady-state event or a transient-state start-up event (e.g., the hydraulic fluid consuming device 200 is starting to consume fluid). The trigger power level, Ptrig, may be manually set by an operator, or statistically established by using a statistical deviation from Pfloor (e.g., +3 standard deviations of the floor reading). Whichever approach is used, a trigger power level, Ptrig, should be set that is distinctive from any level that is representative of general noise that can arise in system 100.

As shown in FIG. 4, an event (e.g., a valve for a hydraulic fluid consuming device opens up) occurs at time t1 because the Pnow reading jumps from a steady level of A to B at Pfloor to above the Ptrig level and subsequently to level C. This is an indication that pump unit 105 is doing work on the hydraulic fluid because a valve or hydraulic fluid consuming device 200 is permitting fluid to flow. The fluid consuming event ends at time t2 because controller 155 has determined that hydraulic fluid consuming device 200 has consumed a sufficient amount of fluid (i.e., the ram and rod of the hydraulic cylinder are at a properly positioned location). As shown in FIG. 4, Pnow drops from level C to level D as the event is about to end, and then past Ptrig to level E, which is at Pfloor once the event has ended.

It is during this time between the initiation of an event at t1 and the end of an event at t2 that controller 155 is determining the power delivered to the hydraulic fluid by pump unit 105 and the volumetric flow rate of the hydraulic fluid delivered to hydraulic fluid consuming device 200 in accordance with the concepts embodied in equations 1-5. Graph 400 of FIG. 4 provides an indication of what area of the power measurements within the time frame between t1 and t2 that controller 155 is interested in using in its determination of power delivered to the hydraulic fluid and the volumetric flow rate. In particular, Pnet, which is the cross-hatched area in FIG. 4, is the region that controller 155 is interested in. Pnet is representative of the incremental power consumed and is equal to Pnow minus Pfloor. Those skilled in the art will recognize that the power level of OA in FIG. 4 drawn by the leakage is of no interest when trying to estimate the hydraulic fluid drawn by opening a valve associated with hydraulic fluid consuming device 200. Furthermore, those skilled in the art will recognize that the total area t1–t2 EDCB in graph captures both the leakage power OA and the incremental power Pnet(t)=Pnow–OA.

Assuming ceteris paribus (i.e., with all things (leakage, friction, windage) held equal it is believed that the power measurements from the wattmeter will be the same before the occurrence of time t1 and the same after the occurrence of time t2), the controller 155 is able to make the approximation of the cross-hatched area (the area enclosed by BCDE). This gives the ability to build a net Flow Rate from Pnet which is the difference of the real-time power, Pnow, and the floor power, Pfloor. As a result, the net flow rate is represented as:

$$\text{Flow Rate}=Q\text{now}-Q\text{floor, wherein} \tag{6}$$

Qnow is the flow rate at Pnow and Qfloor is flow rate when the pump is at Pfloor. Inserting Qnow and Qfloor into equation 5 results in:

$$Q\text{now}=P\text{now}*\eta_m(P\text{now})*\eta_p/(0.435*P\text{reg}) \tag{7}$$

$$Q\text{floor}=P\text{floor}*\eta_m(P\text{floor})*\eta_p/(0.435*P\text{reg}) \tag{8}$$

By substituting equations 7 and 8 into equation 6, the Flow rate can be represented as:

$$\text{Flow Rate}=[P\text{now}*\eta_m(P\text{now})-P\text{floor}*\eta_m(P\text{floor})]*\eta_p/(0.435\times P\text{reg}) \tag{9}$$

The net volume of fluid displaced by the pump from t1 to t2 is the area represented by region BCDE. The net volume of fluid is represented as:

$$V\text{fluid}=\text{Integral}(t1 \text{ to } t2)(\text{Flow Rate}*dt) \tag{10}$$

By substituting equation 9 for Flow Rate, Vfluid can be represented as follows:

$$V\text{fluid}=\text{Integral}(t1 \text{ to } t2)(dt*(P\text{now}*\eta_m(P\text{now})-P\text{floor}*\eta_m(P\text{floor}))*\eta_p/(0.435\times P\text{reg}) \tag{11}$$

Therefore, it is apparent from equations 1-11 that net power is proportional to net flow. As a result, the energy bounded by the cross-hatched region BCDE is also the volume of hydraulic fluid displaced by pump unit 110 at a differential pressure of Preg. The energy expended on raising the volume of fluid Vfluid through constant pressure Preg is equal to Preg× Vfluid, or the energy, net of efficiencies.

In one embodiment, in order to maximize diagnostic capability, values for variables including: the initiation of event t1, the duration of the event, t2–t1, the maximum flow rate, the volume, Pfloor, Ptrig may be stored in memory or data storage of controller 155. The details of how controller 155 uses the aforementioned equations to determine power delivered to the hydraulic fluid by pump unit 110 and accumulators 165 and the volumetric flow rate of the hydraulic fluid delivered to hydraulic fluid consuming device 200 is explained below in more detail with respect to the flow chart of FIGS. 9A-9E.

With both the power delivered to the hydraulic fluid and the volumetric flow rate of the hydraulic fluid determined, controller 155 can use these parameters to ascertain various diagnostics for the hydraulic fluid consuming device and hydraulic pump unit 105 during a steady-state operation and a transient-state start-up operation. Some diagnostics that controller 155 may determine include determining an amount of energy used by the accumulator during the stroking of the hydraulic fluid consuming device, determining an amount of hydraulic fluid displaced during the stroking of the hydraulic fluid consuming device, using the amount of displaced hydraulic fluid as a marker to compare against subsequent measurements of displaced hydraulic fluid obtained from future stroking of the hydraulic fluid consuming device and determining slew time to perform the stroking of the hydraulic fluid consuming device (i.e., the time that the hydraulic fluid consuming device was consuming oil). Details of these diagnostics are described below in more detail with respect to FIGS. 5-6, 7A-7C, 8A-8C, 9A-9E, 10A-10D and 11A-11D.

Figure 5:
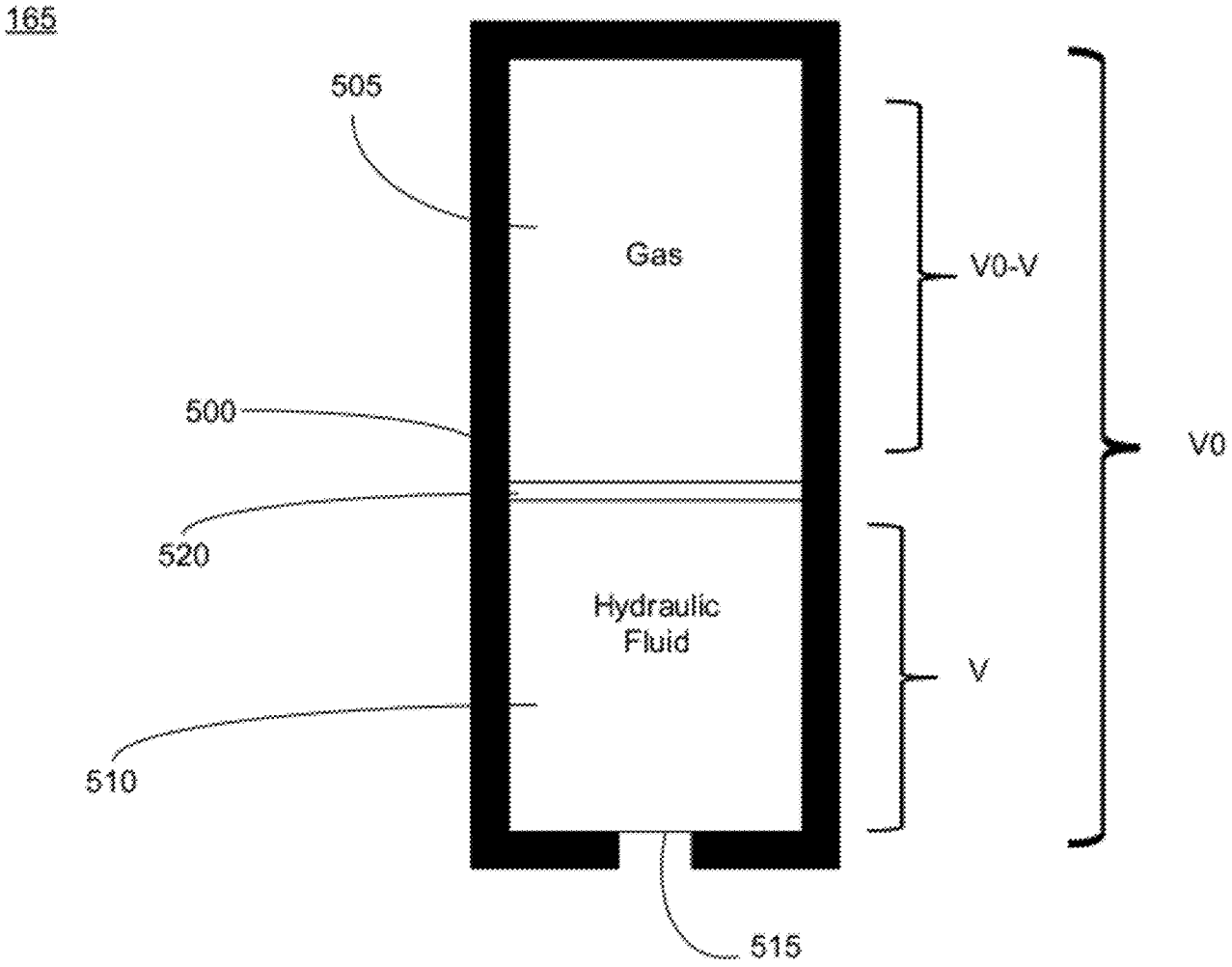
FIG. 5 is a more detailed view of an accumulator depicted in FIG. 1 according to one embodiment of the present invention.

Before discussing the details of the diagnostics that are determined in the various embodiments of the present invention, an understanding of an accumulator is provided. FIG. 5 is a more detailed view of one of the accumulators 165 depicted in FIG. 1 according to one embodiment of the present invention. As shown in FIG. 5, accumulator 165 includes a cylinder 500 having a top chamber 505, a bottom chamber 510 having an inlet 515, and a separation plate 520 separating the top chamber from the bottom chamber. Bottom chamber 510 contains the hydraulic fluid, while top chamber 505 contains an inert gas (e.g., nitrogen) under pressure that provides the compressive force on the hydraulic fluid via separation plate 520. As shown in FIG. 5, the total accumulator storage volume provided by top chamber 505 and bottom chamber 510 is represented by V0. The volume of hydraulic fluid stored by bottom chamber 510 is represented by V, while the volume of gas stored by top chamber 505 is represented by V0–V.

In one embodiment, separation plate 520 may be an elastic diaphragm, a totally enclosed bladder, or a floating piston. As the volume of the compressed gas in top chamber 505 changes, the pressure of the gas and the pressure on the fluid in bottom chamber 510 changes inversely. This change in pressure on the hydraulic fluid in bottom chamber 510 causes it to exit inlet 515 for supply to hydraulic fluid consuming device 200. Those skilled in the art will recognize that this piston type of accumulator is only an example of one type of accumulator that can be utilized with hydraulic system 100. There are other types of accumulators (e.g., spring, bladder, and weight loaded) that can be used, and thus the piston type of accumulator depicted in FIG. 5 is not meant to limit the scope of the aspects of the present invention described herein.

Since one of the functions of accumulator 165 is to use the stored potential energy from the compressed gas to exert a force against the hydraulic fluid, it can be used in conjunction with a smaller pump (e.g., pump unit 110) for instantaneous delivery of the fluid to hydraulic fluid consuming device 200 upon demand. Because accumulator 165 can supply the hydraulic fluid to hydraulic fluid consuming device 200 a lot faster than pump unit 110, the majority of the fluid is provided by the accumulator. In this configuration, pump unit 110 can be used to charge accumulator 165 back up during low periods of demand for the hydraulic fluid. This charging of accumulator 165 will restore volume equilibrium.

The location of separation plate 520 within cylinder 500 as fluid moves in and out of accumulator 165 can be described by the following relationship:

$$P*V^{\gamma}=\text{Constant value for a reversible adiabatic process, wherein} \tag{12}$$

γ equals 1.4 for diatomic nitrogen.

As an example, if accumulator 165 had charging pressure of 1040 psig for a 20 gallon volume and an operating pressure of 1600 psig, then it would drive 5.25 gallons of hydraulic fluid delivered from the accumulator to hydraulic fluid consuming device 200. Essentially, when the pressure is raised from 1040 psig to 1600 psig, then the volume of gas in accumulator 165 compresses from 20 gallons to 14.75 gallons, which means that it has delivered 5.25 gallons of hydraulic fluid to hydraulic fluid consuming device 200.

One can determine diagnostics of hydraulic system 100 by delving further into the operation of pump unit 110, accumulator 165 and hydraulic fluid consuming device 200 after fluid has been delivered to consuming device. This is feasible because pump unit 110 regulates the system pressure to a constant value per the relationship described in equation 12, and the volume in accumulator 165 is a constant in a steady-state as illustrated in the above example.

Figure 6:
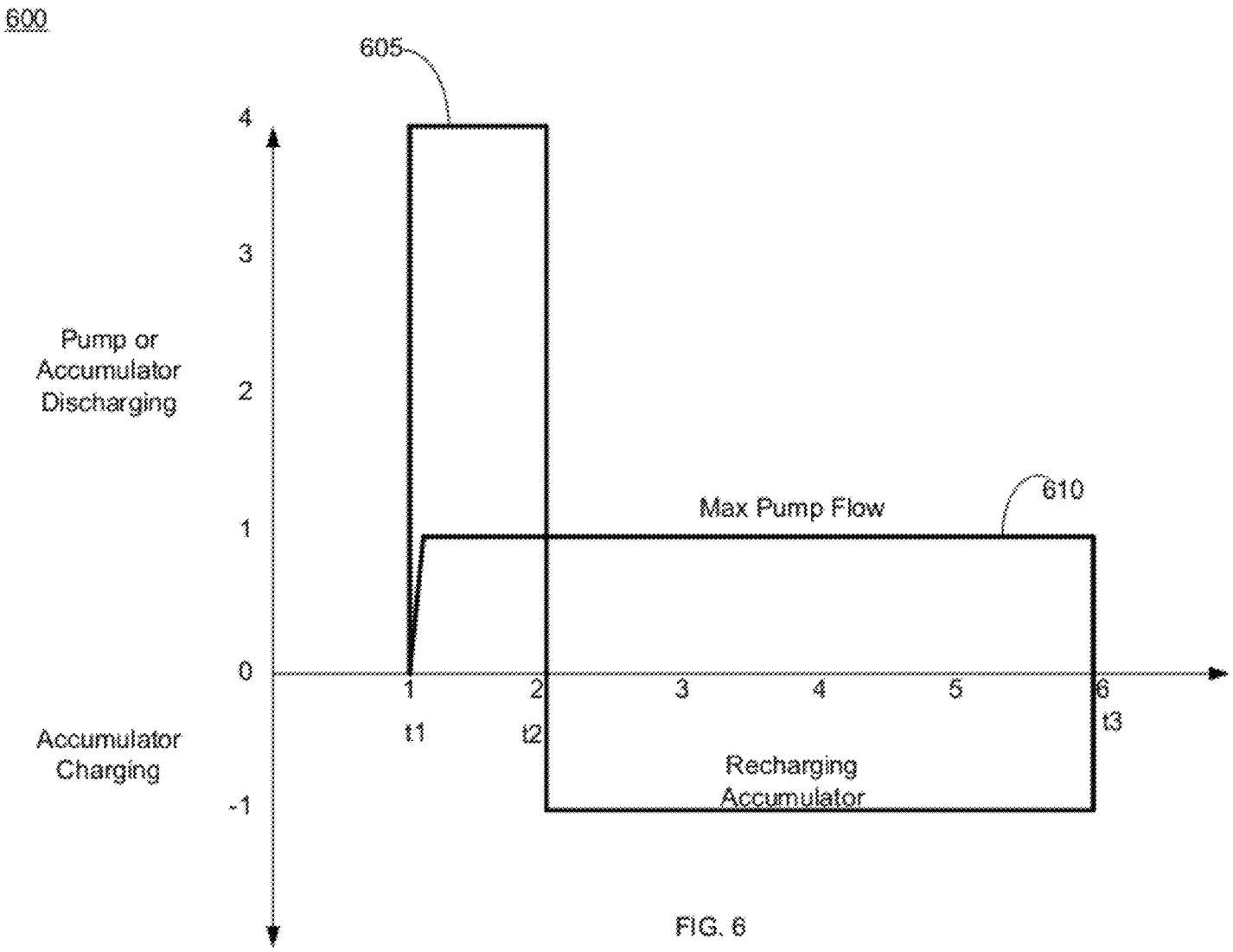
FIG. 6. is a graph illustrating the operation of a pump unit and the accumulators depicted in FIG. 1 according to one embodiment of the present invention.

FIG. 6. is a graph 600 illustrating the operation of pump unit 110 and one of the accumulators 165 depicted in FIG. 1. In particular, FIG. 6 describes how pump unit 110 and one accumulator 165 operate to supply hydraulic fluid to hydraulic fluid consuming device 200 during a transient-state start-up operation. An example of transient-state start-up operation could be when hydraulic pump 105 turns on from a stand-still to provide hydraulic fluid to hydraulic fluid consuming device 200 for a brief period of time. In one embodiment, the transient-state start-up operation is characterized by hydraulic fluid consuming device 200 making a demand for hydraulic fluid (communicates with controller 155 which assigns CVM value). The demand for hydraulic fluid causes a pressure drop in hydraulic pump unit 105. Pump unit 110 and accumulator 165 respond to the pressure drop by delivering the hydraulic fluid to hydraulic fluid consuming device 200. As noted above, the majority of the hydraulic fluid delivered to hydraulic fluid consuming device 200 is supplied by accumulator 165 as opposed to pump unit 110. Accumulator 165 delivers the hydraulic fluid until the demand for fluid by hydraulic fluid consuming device 200 has been satisfied. Pump unit 110 continues operation after the demand for hydraulic fluid by hydraulic fluid consuming device 200 has been satisfied. During this instance, pump unit 110 acts to replenish accumulator 165 with hydraulic fluid and to bring the accumulator back up to system pressure. Eventually, pump unit 110 turns off upon accumulator 165 being replenished.

Those skilled in the art will appreciate that there are various scenarios which can be characterized by the above-described transient-state start-up conditions. Some of these scenarios will be described herein with respect to stroking hydraulic fluid consuming device 200 from a closed position where the delivery of hydraulic fluid is inhibited to an open position where a substantial amount of hydraulic fluid is provided thereto, and back to the closed position where the delivery of hydraulic fluid to the hydraulic fluid consuming device is inhibited. The stroking of hydraulic fluid consuming device 200 can occur individually or as a group lineup where the devices are stroked according to a predetermined pattern.

Referring back to FIG. 6, pump unit 110 and accumulator 165 are in an off state prior to time t1. At time t1, an event occurs which causes pump unit 110 and accumulator 165 to begin supplying hydraulic fluid to hydraulic fluid consuming device 200. Because accumulator 165 responds faster to the demand for hydraulic fluid than pump unit 110, the amount of fluid provided from the accumulator will be greater than the amount provided from the pump. The amount of hydraulic fluid supplied by accumulator 165 to hydraulic fluid consuming device 200 is represented by reference element 605 and the amount of fluid supplied by pump unit 110 to the hydraulic fluid consuming device is represented by reference element 610. In the example provided in FIG. 6, accumulator 165 provides 4 units of hydraulic fluid and pump unit 110 provides 1 unit of fluid, resulting in 5 units being supplied to hydraulic fluid consuming device 200. At time t2, the event is over for accumulator 165 and no further amount of hydraulic fluid is provided to hydraulic fluid consuming device 200. This is evidenced by the precipitous decline in reference element 605 of FIG. 6. The transient-state start-up operation is not over for pump unit 110 as shown in FIG. 6. Pump unit 110 continues to pump fluid, but the fluid is being restored in accumulator 165 and not being supplied to hydraulic fluid consuming device 200. FIG. 6 shows that pump unit 110 starts pumping the hydraulic fluid back into accumulator 165 at time t2 and continues another four time units before shutting off. At this point, accumulator 165 has been brought back up to a system pressure setting (i.e., the gas volume of the accumulator has been restored with energy to respond to the next hydraulic fluid demand event).

Figure 7A:
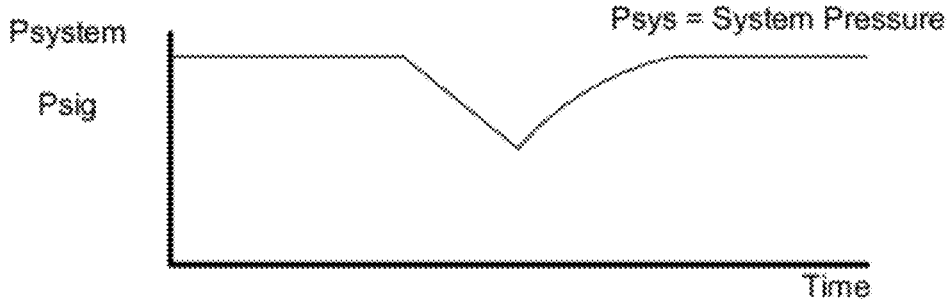
FIGS. 7A-7C show a series of graphs that illustrate operational characteristics of a hydraulic fluid demand event occurring in the system depicted in FIG. 1.
Figure 7B:
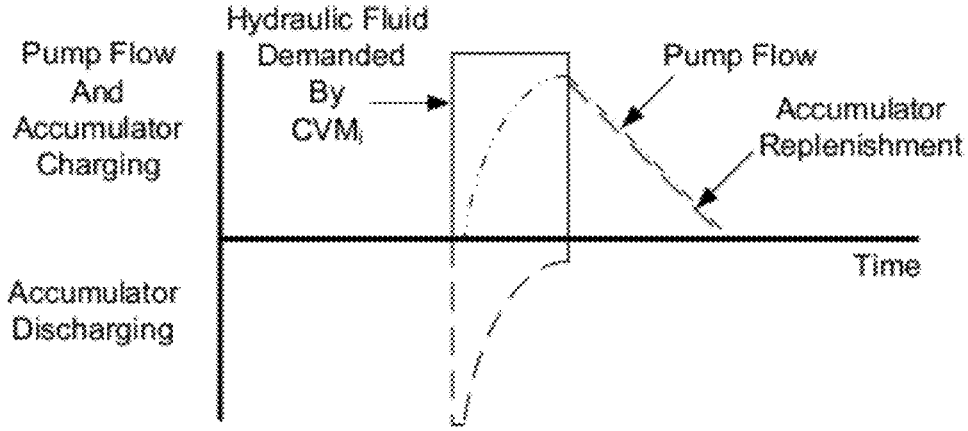
Figure 7C:
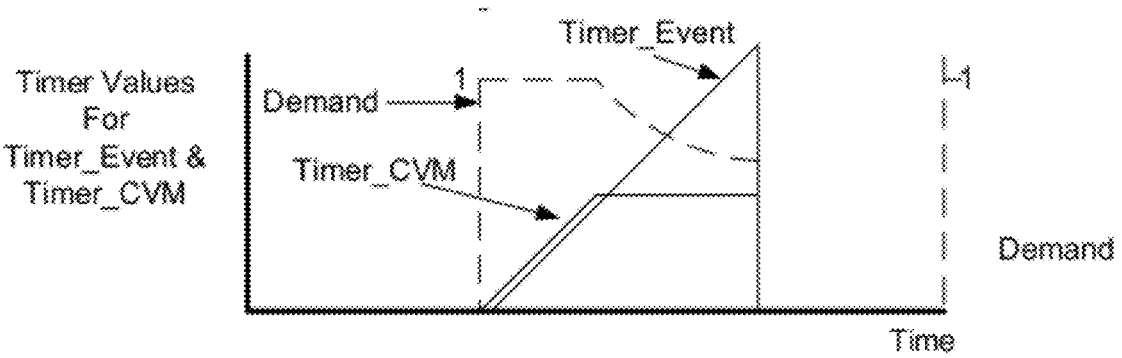

FIGS. 7A-7C show a series of graphs that illustrate operational characteristics of a hydraulic fluid demand event occurring in hydraulic system 100 per a transient-state start-up condition. As used herein, a hydraulic fluid Demand is the ratio of time that hydraulic fluid was demanded to the time of the event. A better understanding of this ratio can be ascertained by referring back to graph 600 of FIG. 6. In particular, the time that hydraulic fluid was demanded in this example is t2−t1, while the time of the event is t3−t1. Thus, the hydraulic fluid demand is characterized as (t2−t1)/(t3−t1). In the example provided by FIG. 6, the hydraulic fluid demand is equal to 0.2 ((2−1)/6−1)).

Referring back to FIGS. 7A-7C, the hydraulic fluid demand event is characterized by a pressure drop (FIG. 7A), flow of hydraulic fluid in response to the pressure drop (FIG. 7B) and the determination of the hydraulic fluid demand (FIG. 7C). More specifically, the pressure curve of FIG. 7A shows a sudden drop in system pressure. This sudden drop in system pressure may be due to the addition of a demand for hydraulic fluid, a valve actuator opening and reducing flow resistance. FIG. 7B shows the immediate response of accumulator 165 to the demand made by hydraulic fluid consuming device 200, followed by a rise of the pump flow in response to the change in system pressure. As shown in FIG. 7B, the pump flow increases until the point where the demand of hydraulic fluid consuming device 200 has been satisfied (response of accumulator drops precipitously back to the time axis). At this point the pump flow is decreasing but is used to replenish accumulator 165 which as shown in FIG. 7B has discharged a substantial amount of its fluid. The pump flow continues until system pressure has been met and accumulator 165 has been recharged. FIG. 7C shows a Demand function, which corresponds to the ratio of time that hydraulic fluid was demanded to the time of the event. In addition to the Demand function, FIG. 7C shows its constituents: the time that hydraulic fluid was demanded and the time of the event. In FIG. 7C, the numerator timer of the ratio of the Demand function (i.e., the time that hydraulic fluid was demanded) is referred to as Timer_CVM, while the denominator timer of the ratio of the Demand function (i.e., the time of the event) is referred to as Timer_Event (i.e., the time that the hydraulic fluid consuming device was consuming oil—slew time). Essentially, Timer_CVM tracks the demand for oil and Timer_Event tracks the time that the pump power exceeds Ptrig.

Figure 8A:
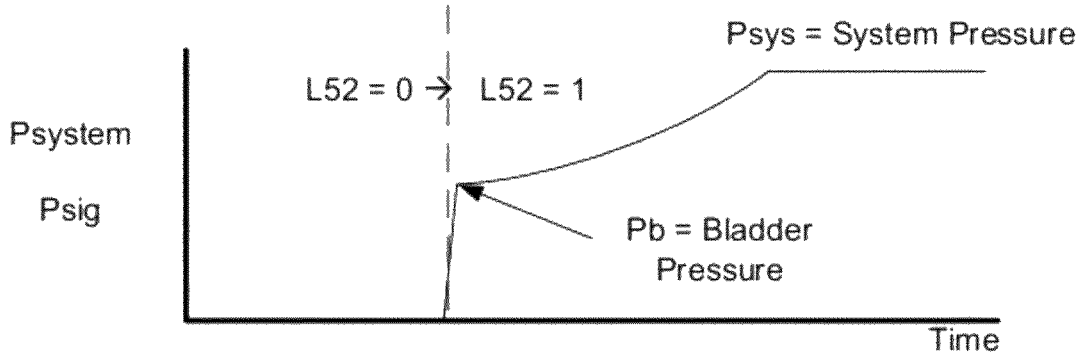
FIGS. 8A-8C show a series of graphs that illustrate operational characteristics of the pump unit depicted in FIG. 1 during a hydraulic fluid demand event occurring in the system depicted in FIG. 1.
Figure 8B:
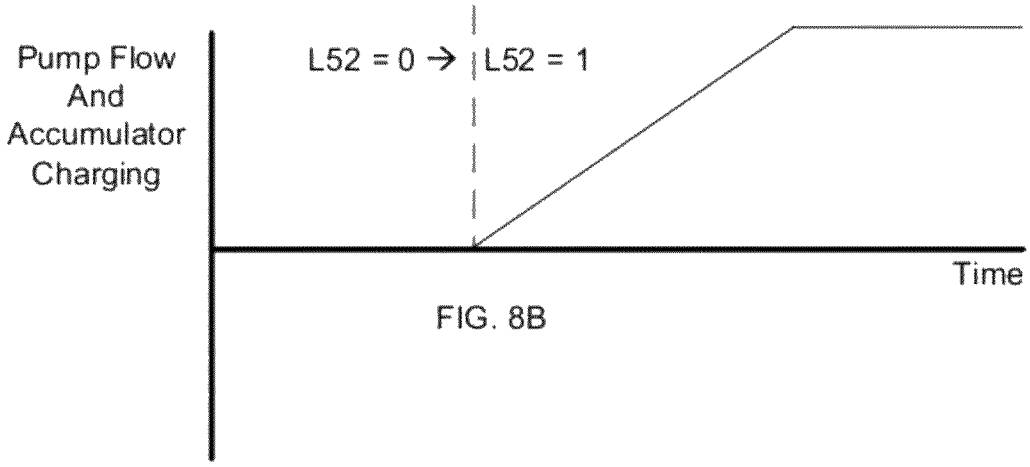
Figure 8C:
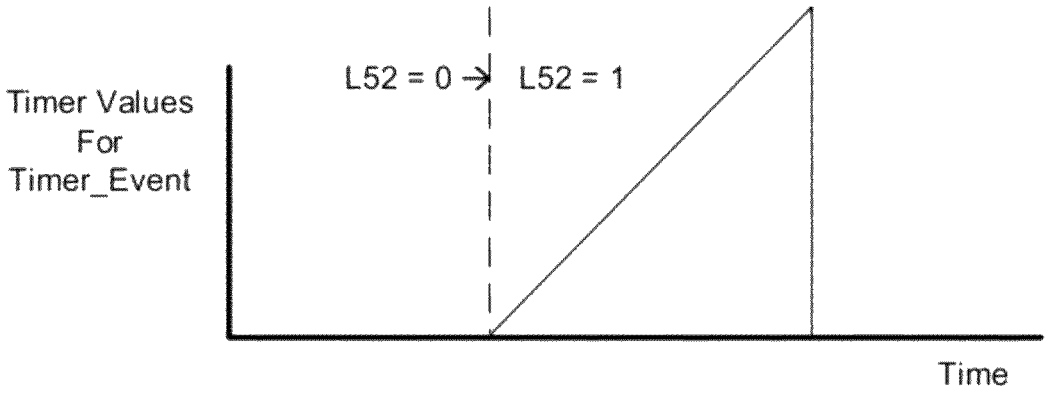

FIGS. 8A-8C show a series of graphs that illustrate operational characteristics of pump unit 110 as it responds to a hydraulic fluid demand event. Generally, FIGS. 8A-8C illustrate what turning pump unit 110 on to pressurize hydraulic system 100 accomplishes. The dotted vertical line in FIGS. 8A-8C represents the starting of electric motor 115. For the sake of using terminology consistent with the flow chart illustrated in FIGS. 9A-9E, the status of motor 115 is represented by variable L52. In one embodiment, the area to the left of the dotted vertical line is represented by the condition where L52 equals zero (i.e., the motor is off), where the area to the right of the dotted line is represented by the condition where L52 equals to one (i.e., the motor is on).

In FIG. 8A, the system pressure rises precipitously to electric motor 115 starting pumping unit 110. When the system pressure reaches the accumulator bladder pressure, Pb, the rate of pressurization drops as pump unit 110 works to compress the gas (e.g., nitrogen) in accumulator 165. FIG. 8B shows that the volume stored in accumulator 165 rises linearly with the maximum flow rate, Qmax, of pump unit 110. The volume stored in accumulator 165 becomes a constant once system pressure has been attained. FIG. 8C illustrates the time values the Timer_Event (i.e., the time from which the demand for hydraulic fluid was made to the end in which the accumulator has been replenished—slew time). In particular, FIG. 8C shows the Timer_Event starts when the motor turns on (i.e., L52 equals 1) and ends when the accumulator has been replenished (recharged) and power measurements fall below Ptrig value.

Using the above information along with the relationships described with respect to equations 1-12 one can develop formulations that describe a hydraulic fluid demand event. First, using the volumes (V0, V and V0−V) depicted in FIG. 5 with the polytropic relationship of equation 12, results in the following relationship:

$$Pb*V0^{\gamma}=\text{constant}=P\text{sys}*(V0-V)^{\gamma}, \text{ wherein} \tag{13}$$

Pb is the accumulator bladder pressure and Psys is the system pressure.

Dividing through by V0 to establish a volumetric ratio gives:

$$Pb=P\text{sys}*(1-(V/V0))^{\gamma}, \text{ wherein} \tag{14}$$

solving for the volume ratio results in:

$$\phi_{volume}=V/V0=1-(Pb/P\text{sys})^{1/\gamma} \tag{15}$$

Using the power measurements from wattmeter 150, one can use equations 3 and 4 to formulate how accumulator 165 fills up with the hydraulic fluid. In particular, equation 4 can be substituted with the instantaneous flow Q (GPM) and differential pressure P (psig) values from pump unit 110 to result in Pfluid being defined as:

$$P\text{fluid}=P\text{mech}*\eta_{pump}$$

$$P\text{fluid}=0.435*Q*P \tag{16}$$

In one embodiment, the flow rate of pump unit 110 is assumed to be at its maximum. Thus, for a pump unit that is of a swash plate type, the swash plate will be at a maximum angle, so it is assumed that:

$$Q=\text{GPM}_{max} \tag{17}$$

The total volume of hydraulic fluid pumped into accumulator 165 is a relationship to the total time of the event as defined in Timer_Event. In particular, the volume of hydraulic fluid in accumulator 165, V, is defined as:

$$V=\text{GPM}_{max}*\text{Timer_Event}/60 \tag{18}$$

It is now possible to establish the instantaneous differential pressure P from a constant flow as:

$$P=P\text{fluid}/(0.435*GPM_{max}) \tag{19}$$

Using algebra with equation 3 and 19 results in:

$$P=P\text{elec}*\eta_{motor}(P\text{elec})*\eta_{pump}/(0.435*\text{GPM}_{max}) \tag{20}$$

A relationship between the average pressure during pressurization and the bladder pressure Pb can be established using the polytropic process described for an accumulator. In particular, given the assumption that the pump is running at maximum flow during the initial system pressurization, the volume of oil occupying the cylinder, V, is:

$$V=\frac{GPM_{max}}{60}*\text{Timer_Event} \tag{21}$$

Consider that the full volume of the cylinder, V0, is known, an oil volume fraction value $\phi_{volume}$ may be determined as follows:

$$V0=\text{Maximum Volume of Accumulator} \tag{22}$$

$$\phi_{volume}=V/V0 \tag{22}$$

The following development seeks a method to relate the pressure developed from electric power measurement to the original gas charging pressure of the accumulator bladder, Pb. To accomplish this, those skilled in the art of thermodynamics understand that since the polytropic process $P*V^{\gamma}$=constant, that the initial state with gas at a pressure Pb and no oil (V=0, V0−V=V0) is equal to the final state a system pressure P and oil volume V, reducing the gas volume to V0−V as follows:

$$Pb*V0^{\gamma}=P*(V0-V)^{\gamma} \tag{23}$$

The fluid work done by the pump to further compress the accumulator gas from Pb to P is accomplished by the classic P dV work as follow:

$$\text{Energy Stored}=\int_0^V P(V')*dV'=\int_0^V \frac{Pb*V0^{\gamma}}{(V0-V')^{\gamma}}*dV'=\frac{Pb*V0^{\gamma}}{\gamma-1}*((V0-V)^{1-\gamma}-V0^{1-\gamma}) \tag{24}$$

$$\text{Energy Stored}=\frac{Pb*V0}{\gamma-1}*\left(\left(\frac{V0}{V0-V}\right)^{\gamma-1}-1\right)$$

Average pressure may be determined simply by integrating P over time and dividing by time. To define the volume weighted average for pressure, one can divide the energy stored by V. Those skilled in the art of distribution theory recognize that:

$$Pavg=\text{Average Pump Pressure from Oil Volume}=0 \text{ to } V \tag{25}$$

$$Pavg=\frac{\int_0^V P(V')*dV'}{V}=\frac{Pb}{\gamma-1}*\frac{V0}{V}*\left(\left(\frac{V0}{V0-V}\right)^{\gamma-1}-1\right) \tag{26}$$

$$\text{Note that } \frac{V0}{V0-V}=\frac{1}{1-(V/V0)}=\frac{1}{1-(\phi_{volume})}$$

$$Pavg=\frac{\int_0^V P(V')*dV'}{V}=\frac{Pb}{\gamma-1}*\frac{1}{\phi_{volume}}*\left(\left(\frac{1}{\phi_{volume}}\right)^{\gamma-1}-1\right) \tag{27}$$

Note that the desired relationship between average pressure and the bladder pressure Pb is obtained in closed form. The volume V is determined by the maximum flow and the timer. The volume ratio is known because V0 is provided by a user. Therefore, the expression for $\phi_{volume}$ is established as:

$$\frac{Pb}{Pavg} = f(\phi_{volume}) = \frac{(\gamma - 1) * \phi_{volume}}{\left(\left(\frac{1}{1 - (\phi_{volume})}\right)^{\gamma - 1} - 1\right)} \tag{28}$$

Since the volume is assumed to increase linearly with time due to the flow rate fixed at GPMmax for the duration of the start, it is also true that:

$$Pavg = \frac{\int_0^{Timer_Event} P(t) * dt}{\text{Timer_Event}} \tag{29}$$

This value is easily determined by integrating equation 20 over time and dividing by the time of the event to establish an average pressure.

The implementation of the above relationships and formulations are implemented by controller 155 and further details as they are used to obtain diagnostics of a transient-state start-up operation, in which hydraulic fluid is provided to hydraulic fluid consuming device 200 for a predetermined amount of time is described in FIGS. 9A-9E. One scenario of a transient-state start-up operation in which examples of diagnostics can be obtained occurs during the stroking of hydraulic fluid consuming device 200 by a plant operator or field technician. In one embodiment, hydraulic fluid consuming device 200 can be stroked by using a portable human interface machine device. When hydraulic fluid consuming device 200 is stroked, it typically moves from a closed position (e.g., a zero position) having no hydraulic fluid to an opened position (e.g., a 100% fully opened position) so that it is filled with a substantial amount of fluid and back to the closed position with no fluid therein.

As explained with respect to FIGS. 9A-9E, one can use wattmeter 150 and the above equations to keep track of the amount of hydraulic fluid that is displaced during the exercise or stroking of hydraulic fluid consuming device 200. This facilitates the obtaining of diagnostics which can include determining an amount of energy used by accumulator 165 during the stroking of hydraulic fluid consuming device 200, determining an amount of hydraulic fluid displaced during the stroking of the hydraulic fluid consuming device, using the amount of displaced hydraulic fluid as a marker to compare against subsequent measurements of displaced hydraulic fluid obtained from future stroking of the hydraulic fluid consuming device, and determining slew time to perform the stroking of the hydraulic fluid consuming device (i.e., the time that the hydraulic fluid consuming device was consuming oil). All of these diagnostics can be used in the evaluation of the overall health of hydraulic system 100.

Another scenario of a transient-state operation in which examples of the above-noted diagnostics can be obtained occurs during a valve line-up with all of the hydraulic fluid consuming devices 200 utilized in hydraulic system 100. In this embodiment, a plant operator or field technician can use a portable human interface machine device to perform the valve line-up with the hydraulic fluid consuming devices 200. In this embodiment, each of the hydraulic fluid consuming devices are stroked individually. Next, a pair of the hydraulic fluid consuming devices is then stroked. Afterwards, a trio of the hydraulic fluid consuming devices is stroked after stroking the pair of devices. The amount of hydraulic fluid consuming devices that are stroked increases progressively until all of the devices have stroked together. Those skilled in the art will recognize that this is one approach to performing a line-up exercise and that there may be other patterns used.

The line-up exercise described herein allows one to stress hydraulic system 100 to see how well it performs through an overly high demand of hydraulic fluid. In particular, this line-up exercise will come close to bringing the accumulators to depletion and wind up running on just the pump unit 110. More specifically, the line-up exercise produces high volume flows that will cause the accumulators to deeply deplete. As a result, the pump will need to run a long time after the depletion to restore the fluid. This causes lower Demand values that will be characteristic of the accumulator health. Performing this test periodically allows one to compare the Demand values to historical values to see if the volume available or the pressure has changed.

If the available volume of accumulation, V0, is too small due to maintenance of a cylinder, the Demand function will increase relative to a proper system configuration. This is due to the fact that the pump takes less time to recover with less volume on line. Likewise, if bladder pressure is low, then Demand will also be high because the accumulators participate less when under pressured. This makes them easier to refill after the need for oil is over. In one embodiment, determining the status of volume and bladder pressure is performed by a start-up test. Thus, in one embodiment, the above-noted exercise can be used to act as a trending tool that provides operational health information of accumulator 165.

FIGS. 9A-9E illustrate a flow chart 900 describing process operations associated with obtaining diagnostics for hydraulic system 100 according to one embodiment of the present invention. The process operations begin in FIG. 9A at 902 where the central processor associated with controller 155 and software implementing portions of the various embodiments of the present invention are booted. At 904 variables associated with various calculations and diagnostics are initialized. In one embodiment, input variables are classified as measured variables, valve command variables (hydraulic fluid consuming device variables) and user-supplied variables. In one embodiment, the measured variables include Pnow and L52 (motor on or motor off). Valve commands may include CVM (i.e., consume or do not consume hydraulic fluid). User-supplied variables may include GPMmax (max flow rate), Pfloor (floor power level), Preg (regulated pressure across pump), Ptrig (trigger power level), V0 (total accumulator storage volume), MaxTime (the maximum length of time for an event to occur), dt (a time step for performing an integration), $\eta_{motor}$(Pelect) which is the efficiency of motor 115 and $\eta_{pump}$ which is the efficiency of pump unit 110.

In addition to input variables, there are a set of output variables that are initialized. In one embodiment, the output variables may be classified as dynamic output and output storage array of previous events that are stored on a hard drive or random access memory (RAM) of controller 155. The dynamic output variables may include valve demand (Demand), components associated with the valve demand (Components), event number (Event#), event timer variable for valve (Timer_CVM), event timer variable for process (Timer_Event), current volume of fluid (Vfluid), and a maximum time alarm (MaxTime_Alarm). The output storage array of previous event variables may include Vfluid, Timer_CVM, Timer_Event, Pmax (maximum power), Components, Demand and accumulator bladder pressure (Pb).

As explained below with regard to the other steps of flow chart 900, other variables are used during the process to arrive at the calculated outputs. Some of these variables may include IntSW, Int_Reset, Istart, Pmax, and Pmech. Other variables may include IntSW_Old, L52_Old, Vfluid_Old, P_Int_Old, P_int, Pavg, P_Int/Timer_Event, P_avg, ICVM, ICVM_Old and an oil volume fraction value $\phi_{volume}$. The details of these variables are explained below in more detail as they appear in the process operations described in FIGS. 9A-9E.

Those skilled in the art will recognize that the input variables, output variables, and the variables used to produce the outputs from the inputs are representative of one approach that may be used to program controller 155 to perform the aforementioned calculations and diagnostics. Other approaches are within the scope of the ability of artisans skilled in computer programming. The various embodiments of the present invention are not meant to be limited to any particular technique of programming controller 155 described herein.

Referring back to flow chart 900, the instantaneous power reading from wattmeter 150, Pnow, is evaluated and compared at 906 to a trigger power level Ptrig to determine if there is an event. This trigger may be provided by a user, or statistically established from the floor power Pfloor (e.g., its mean+3 standard deviations). If Pnow is greater than the trigger, Ptrig, either a flow event started or was already in process. As indicated in 908 the integrator switch variable IntSW is 1 for an event and 0 as shown at 910 if there is no event.

At 912, a decision is made to determine if electric motor 115 has started. In particular, the decision at 912 includes determining if L52 equals 1 and L52_Old equals 0. If L52 equals 1 and L52_Old equals 0, then this is indication that motor 115 has started in response to a new event. As a result, controller 155 starts to get ready for the data processing operations associated with the new event at 914 and 916. In particular, at 914 the integration reset variable Int_Reset is set to 1, the Istart variable is set to 1 (an indication that the system has started from 0 pressure with a new motor start), the L52_Old variable is set to 1, the Vfluid variable is set to 0 and the P_Int_Old variable (the prior value of the average pressure integral) is set to 0. At 916, controller 155 prepares the start new event statistic variables. In one embodiment, preparing the start new event statistic variables includes setting Event# equal to Event#+1, setting Timer_Event equal to 0, setting Pmax equal to Ptrig and setting Pb to 0.

If it is determined at 912 that electric motor 115 has not started (L52 equals 1 and L52_Old equals 0 is not true), then the process operations 914 and 916 are bypassed and flow chart 900 continues to process operation 918.

At 918, a decision is made to determine whether a starting event is in progress. In particular, it is determined at 918 whether Istart equals 0. If Istart equals 0 then this is an indication that an event is not in process. On the other hand, if Istart equals 1, then this is an indication that a starting event is in progress (i.e., a steady-state event). As a result, process operations 920-924 are bypassed and flow chart 900 continues to program string A in FIG. 9B.

If it is determined at 918 that a starting event is not in progress (i.e., Istart equals 0), then a decision is made at 920 to determine if an event has just begun. In particular, the decision at 920 includes determining if the integration switch IntSW_Old equals 0 and the current integration switch IntSW equals 1. In one embodiment, this condition is brought about when Pnow is greater than Ptrig. If the old value of integrator switch (IntSW_Old) is 0 and the current value of integration switch IntSW is 1, then an event has just begun and requires initialization. Otherwise the initialization associated with process operations 922 and 924 are bypassed and flow chart 900 continues to program string A in FIG. 9B.

If controller 155 confirms that an event has just begun at 920, then at 922 the integration reset variable Int_Reset is set to 1, the integration old switch variable IntSW_Old is set to 1, the Vfluid variable is set to 0, and the P_Int_Old variable is set to 0. Controller 155 continues to get ready for the data processing operations associated with a new event at 924 by preparing the start new event statistic variables. In one embodiment, preparing the start new event statistic variables includes setting Event# equal to Event#+1, setting Timer_Event equal to 0, setting Pmax equal to Ptrig and setting Pb to 0.

Figure 9A:
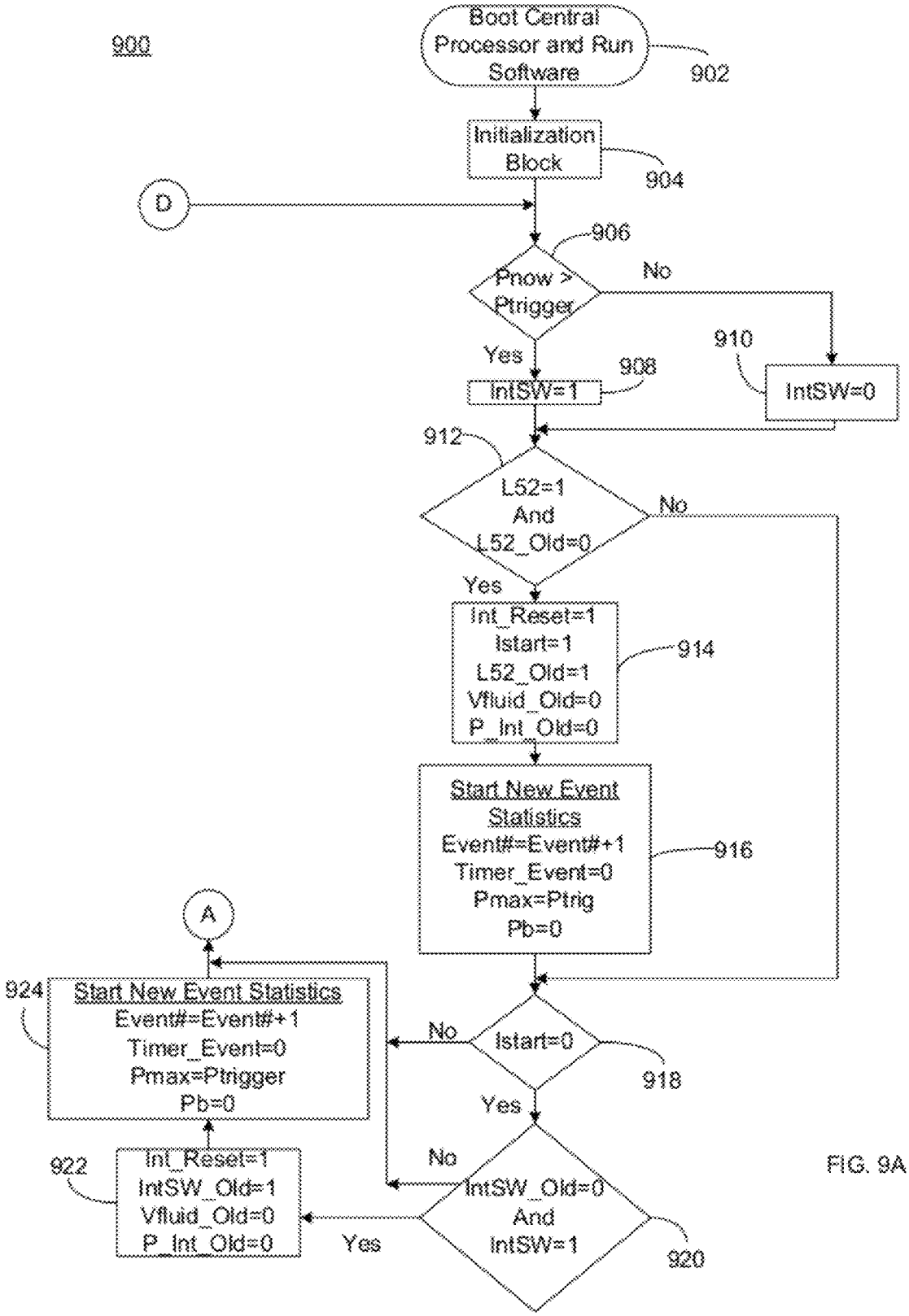
FIGS. 9A-9E illustrate a flow chart describing process operations associated with obtaining diagnostics for the hydraulic system depicted in FIG. 1 according to one embodiment of the present invention.
Figure 9B:
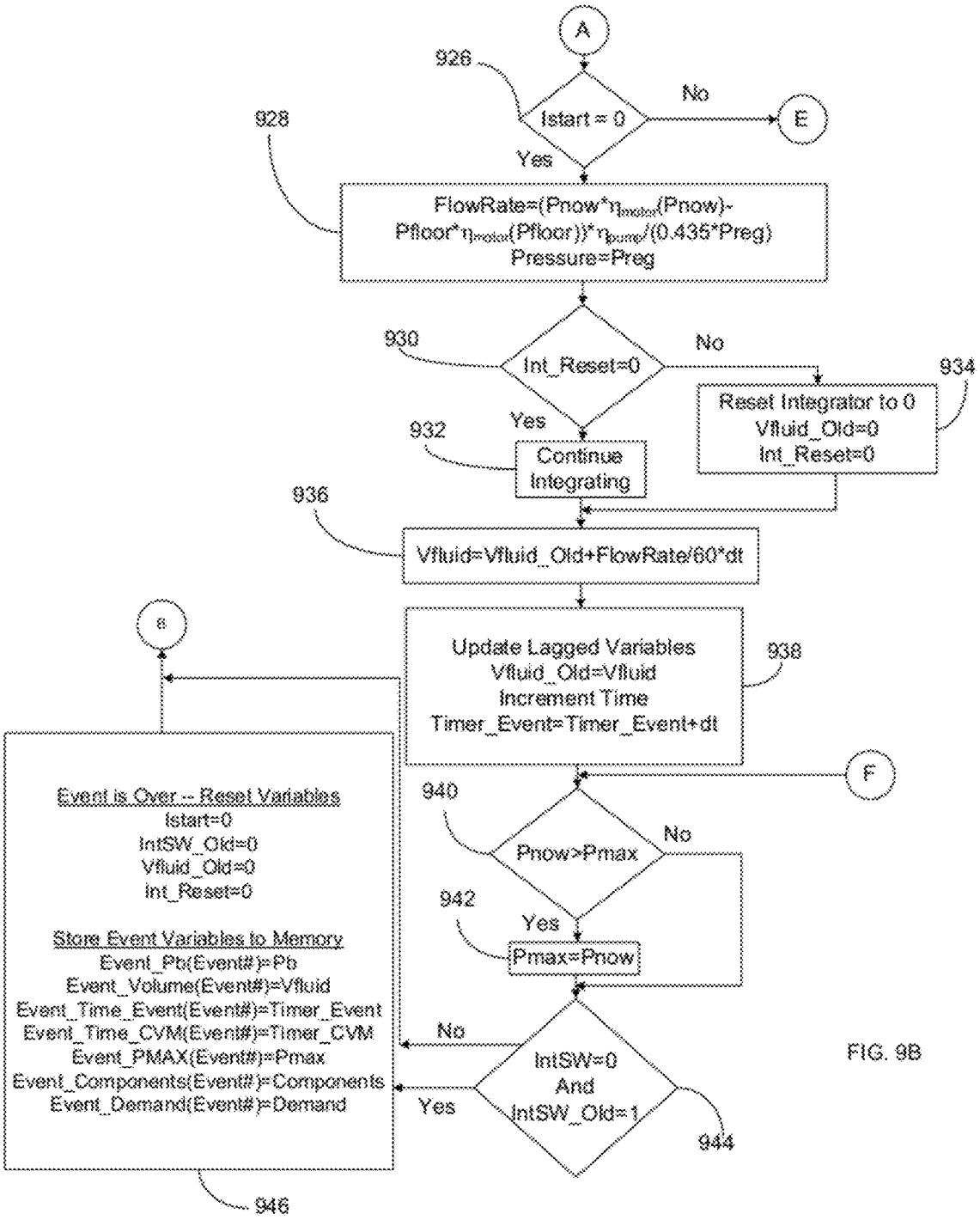

Continuing onto program string A shown in FIG. 9B, controller makes another determination as to whether a starting event is in progress. In particular, it is determined at 926 whether Istart equals 0. If Istart equals 0 then this is an indication that an event is not a motor start-up transient event. On the other hand, if Istart equals 1, then this is an indication that a starting event is in progress. If it is determined that Istart equals 0, then controller 155 implements equation 9 at 928 to determine the net flow rate in excess of leakage, friction and windage. Next at 930, a decision is made as to whether the integration reset variable Int_Reset is equal to 0. Checking that the integration reset variable Int_Reset is equal to 0 ensures that controller 155 is considering a new event. If controller 155 determines at 930 that the integration reset variable Int_Reset is equal to 0, then it continues with integration of the flow rate at 932 to obtain the volumetric flow rate. On the other hand, if controller 155 determines at 930 that Int_Reset is not equal to 0, then it needs to set the fluid volume variable Vfluid_Old to 0 and the integration reset variable Int_Reset to 0 at 934.

At 936, controller 155 performs the integration of the flow rate to obtain the volumetric flow rate, implementing equation 11. In one embodiment, controller 155 may utilize a simple first-order Euler integration method to obtain the volumetric flow rate. Those skilled in the art will recognize that this is only one approach and that there are several other methods available to perform the integration.

At 938, controller 155 updates the old fluid volume variable Vfluid_Old by Vfluid to continue the integral in the next step, if required. In addition at 938, the timer associated with controller 155 is incremented by the time step dt.

Figure 9C:
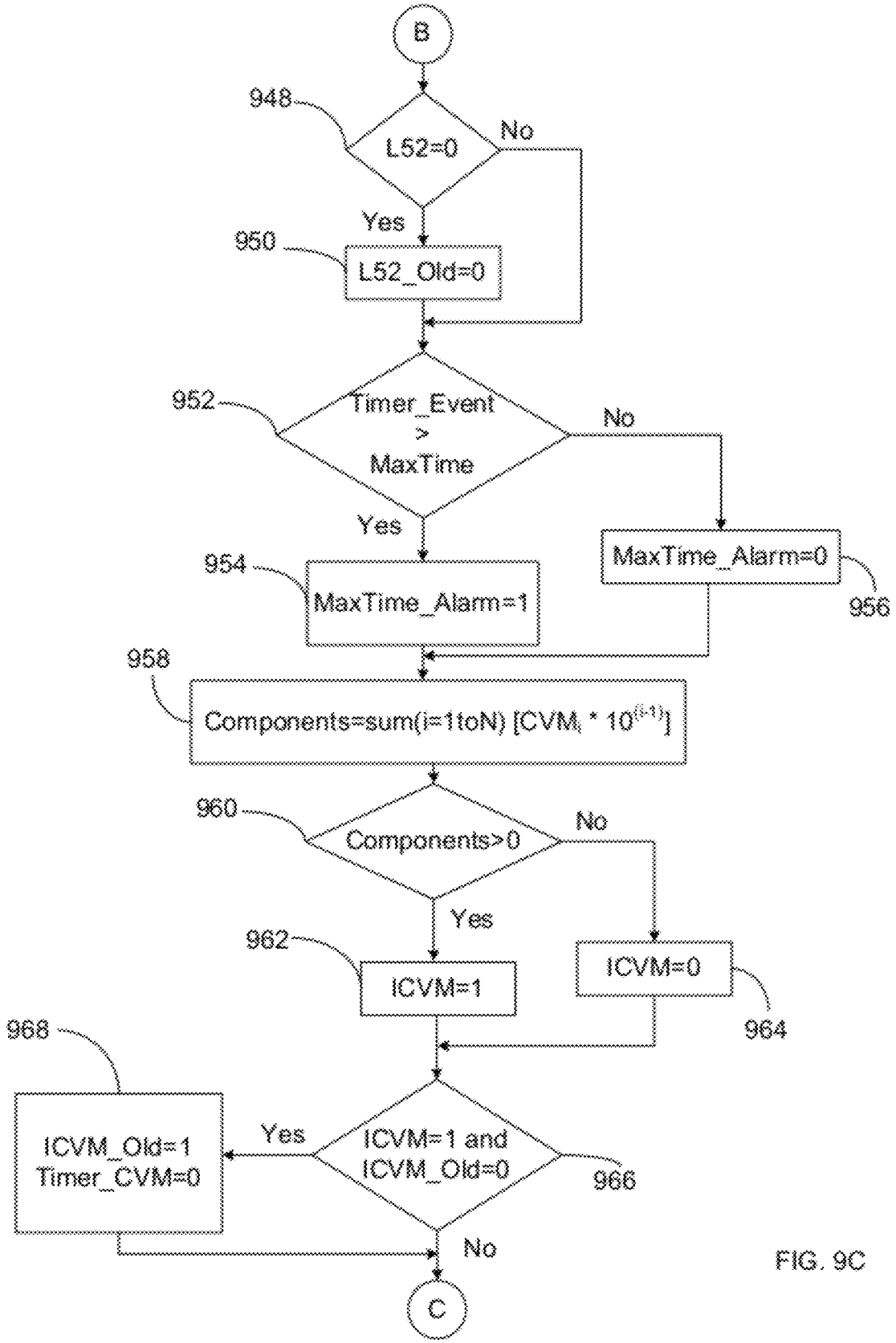
Figure 9D:
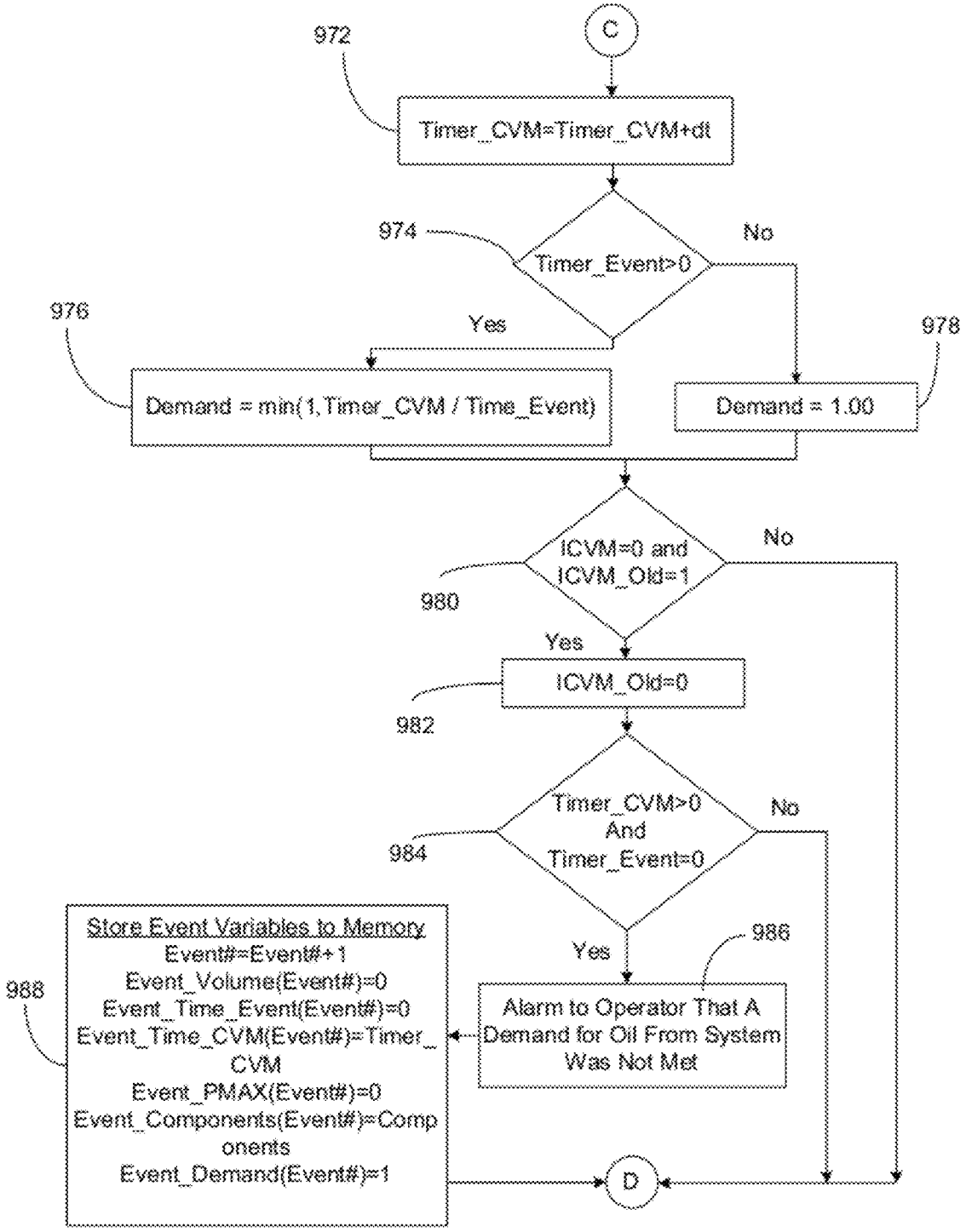
Figure 9E:
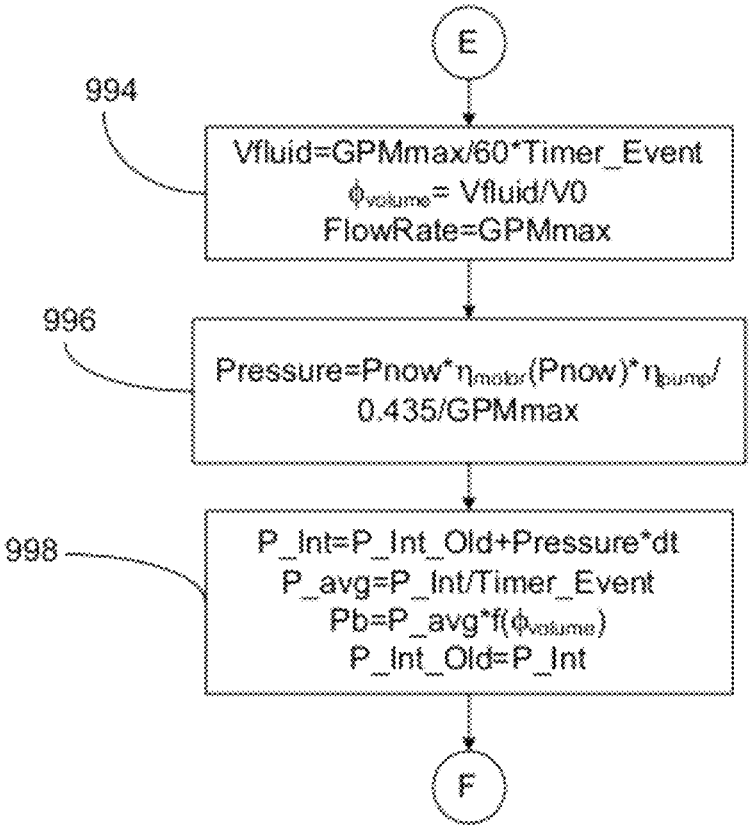

If at 926, a starting event is in progress (i.e., Istart equals 1), then flow chart 900 continues to program string E in FIG. 9E. In program string E, flow chart continues at 994 where controller 155 determines the volumetric flow rate. In addition, at 994, controller 155 updates the old fluid volume variable Vfluid_Old by Vfluid and determines the $\phi_{volume}$ by dividing Vfluid variable by the variable V0 (total storage volume of accumulator).

At process operation 996, controller 155 determines pressure the system pressure Psys according to equation 20. After determining the system pressure at 996, controller 155 first performs the time integral of pressure, the numerator of the average pressure expression. It then divides by the elapsed event timer Timer_Event to form Pavg. Then controller 155 uses $\phi_{volume}$ to enter the expression for the ratio of Pb/Pavg at 998 (equation 28). After performing these operations at 998, flow chart 900 continues to program string F which goes back into FIG. 9B between operations 938 and 940.

Next, a determination is made as to whether the power measurement obtained from wattmeter 150 has reached the maximum value Pmax. Generally, this determination is made in order to create an event statistic for the maximum power drawn. At 940, controller 155 determines if Pnow is greater than Pmax. If true, controller 155 sets Pmax equal to Pnow at 942. If false, the logic bypasses 942 and continues to another decision at 944. In particular, it is determined whether the integration switch variable IntSW equals 0 and the old integration switch variable IntSW_Old equals 1. Essentially, controller 155 is determining at 944 whether the sudden drop of Pnow to below Ptrig signals an end of an event. If it is determined to be false at 944, then the process operation bypasses processing block 946, and continues to programming string B. On the other hand, if it is true, all lagged variables such as Istart, IntSW_Old, Vfluid_Old and Int_Reset are reset to 0 at 946. In addition, all values for event variables such as Pb, Vfluid, Timer_Event, Timer_CVM, Pmax, Components and Demand are stored in memory or written to storage at 946.

Continuing onto program string B shown in FIG. 9C, controller 155 continues with the aspect of determining diagnostics for hydraulic pump unit 105 and hydraulic fluid consuming device 200. At 948, controller 155 determines whether electric motor 115 has turned off. In particular, controller 155 determines whether the L52 variable equals zero. If electric motor 115 is off, then controller 155 updates the lagged variable L52_Old to equal 0 at 950. If it is determined at 948 that electric motor 115 is on (L52 equals 1) then the process operation bypasses processing block 950 and continues to the decision at 952.

At 952, controller 155 is interested in determining whether the event has taken too long to end. For example, Pfloor may have risen above Ptrig which is causing the delay in the event to end. Specifically, controller 155 determines at 952 whether the timer event variable Timer_Event is greater than the specified maximum time MaxTime. If the time has been exceeded, then an alarm variable is set to 1 at 954 in order to notify an operator. On the other hand, if the time has not been exceeded, then an alarm variable is maintained at a current state of 0 as indicated at 956 and the operator is not notified.

The process continues at 958 where controller 155 computes a valve state number for each hydraulic fluid consuming device 200 as indicated by their respective CVM value and sums up the valve state numbers for the Components variable. Essentially, controller 155 is keeping track of what the status was for all of the valves when they were on (i.e., CVM=1). Those skilled in the art will recognize that even though a base of 10 is shown in step 958 a base of 2 may be equally convenient for establishing a methodology to store CVM values. Also, note that if none of the valves (hydraulic fluid consuming devices 200) are on, then the Components variable will be 0.

Once the Components variable is computed, controller determines at 960 whether the Components variable is greater than 0. If the Components variable is greater than 0, then the ICVM variable, an event status variable, is set to 1 at 962. This is an indication that a hydraulic fluid consuming device is demanding fluid. Alternatively, if the Components variable is less than 0, then the ICVM variable is set to 0 at 962. This is an indication that no hydraulic fluid consuming devices are demanding fluid.

Next, controller 155 determines whether a new Demand from hydraulic fluid consuming device 200 has begun. In particular, controller 155 determines whether ICVM equals 1 and ICVM_Old equals 0 at 966. If ICVM equals 1 and ICVM_Old equals 0, then the variable is updated in memory and the timer for CVM is initialized. In particular, controller 155 sets ICVM_Old to 1 and Timer_CVM to 0 at 968. Alternatively, if controller 155 determines that the condition of decision 966 is not true, then flow chart 900 bypasses 968 and goes to program string C on FIG. 9D.

Program string C starts at 972 where the timer variable Timer_CVM is set to Timer_CVM+dt in order to track the amount of time that the valve or valves demanded hydraulic fluid from hydraulic pump unit 105. As mentioned above, this value forms the numerator of the variable Demand, which expresses the ratio of the time the valve(s) demanded fluid to the time that it took hydraulic pump unit 105 to complete the event.

At 974 controller 155 determines whether the Timer_Event variable value is greater than 0. If it is determined that Timer_Event is greater than 0 then, the Demand is determined at 976 by taking the ratio of Timer_CVM (the time of the demand for fluid) to the time of the event (Timer_Event). Essentially, the Demand is being clamped to be no greater than 1. Alternatively, if the Timer_Event variable value is less than 0 than the Demand is determined at 978 to be at a limit of 1.

Next, controller 155 determines whether the demand for hydraulic fluid by hydraulic fluid consuming device 200 has ended. In particular, controller 155 determines whether ICVM equals 0 and ICVM_Old equals 1 at 980. If ICVM equals 0 and ICVM_Old equals 1, then this is an indication that the demand for oil has ended. As a result, the ICVM_Old variable is updated in memory to have a value of 0 at 982. Alternatively, if it is determined that the demand for oil has not ended, then flow chart goes to program string D and returns to FIG. 9A at the portion after the booting of controller 155 and initialization of the various process variables.

After updating the ICVM_Old variable at 982, the process operations continue at 984 where controller 155 determines whether Timer_CVM is greater than 0 and Timer_Event is 0. Essentially, controller 155 is interested in determining whether hydraulic system 100 has met the demand for hydraulic fluid. If it is determined that Timer_CVM is greater than 0 and Timer_Event is 0, then controller 155 generates an alarm at 986 that notifies the operator that a demand for hydraulic fluid from hydraulic system 100 was not met. Alternatively, if it is determined at 984 that the demand for oil has been met, then flow chart goes to program string D and returns to FIG. 9A at the portion after the booting of controller 155 and initialization of the various process variables.

The various determinations made by controller 155 for this particular event can be placed in storage at 988. Examples of variables associated with the event that are stored include the event number, Volume, Time Event, Time CVM, Pmax, Components, and Demands. In one embodiment, these variable could be stored as Event#, Event_Volume, Event_Time_Event, Event_Time_CVM, Event_Pmax, Event Components and Event_Demands.

Figure 10A:
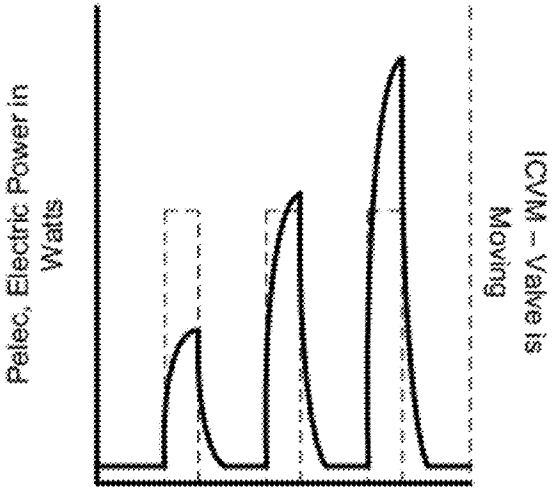
FIGS. 10A-10D and FIGS. 11A-11D are examples of screen displays that may be presented to an operator while utilizing the controller to obtain diagnostics according to one embodiment of the present invention.
Figure 10B:
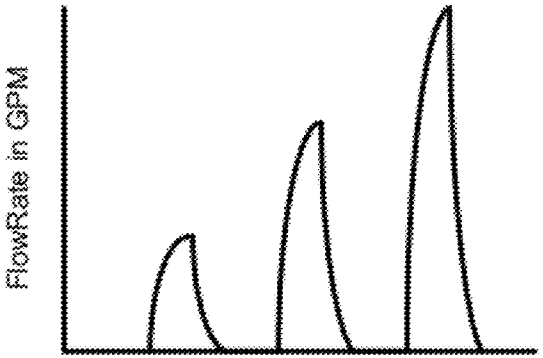
Figure 10C:
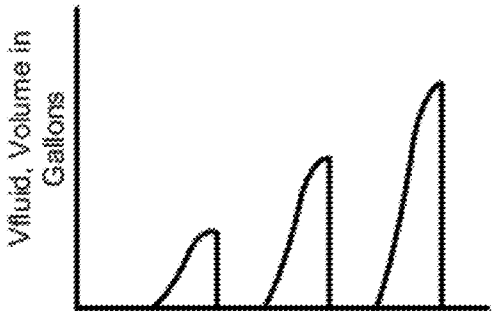
Figure 10D:
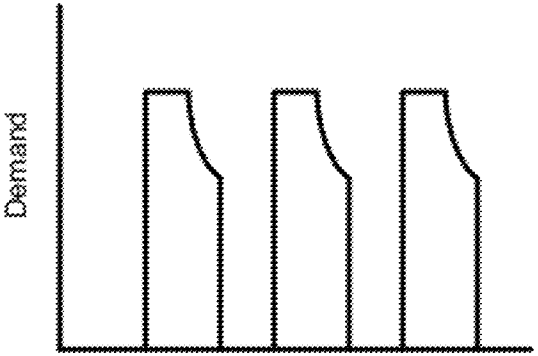

In one embodiment, controller 155 can use the stored data to generate a plurality of plots of waveforms describing operational effects associated with the hydraulic fluid demand event. FIGS. 10A-10D provide some examples of screen displays that may be presented to an operator that include plots of waveforms that describe operational effects associated with the hydraulic fluid demand event. In particular, FIGS. 10A-10D show examples of plots that may be generated upon performing the aforementioned valve line-up exercise. More specifically, FIGS. 10A-10D show the stress test stroking of a first hydraulic fluid consuming device (i.e., valves), then two hydraulic fluid consuming devices and finally three devices, while hydraulic system 100 is running in steady-state. FIG. 10A shows the raw electric power data, Pelec, obtained from wattmeter 150. Using equation 9, power is transformed to flow rate by making the approximation that the system pressure remains close to the regulated pressure, Preg. FIG. 10B shows the flow rate for each stroking of the hydraulic fluid consuming devices. FIG. 10C shows the net volume of fluid displaced by pump unit 105 when Pelec exceeds Ptrigger. FIG. 10D shows the Demand function, which is the ratio of the time the fluid is demanded to the time that the power is greater than Ptrigger (i.e., time of the event).

Figure 11A:
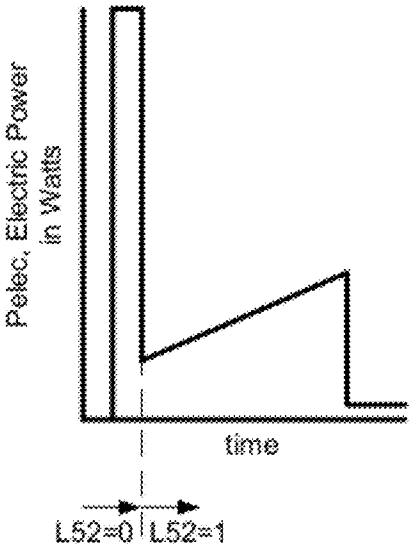
Figure 11B:
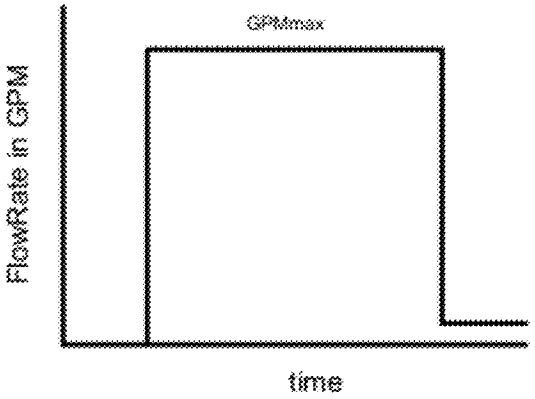
Figure 11C:
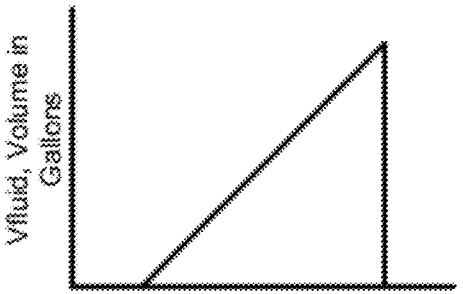
Figure 11D:
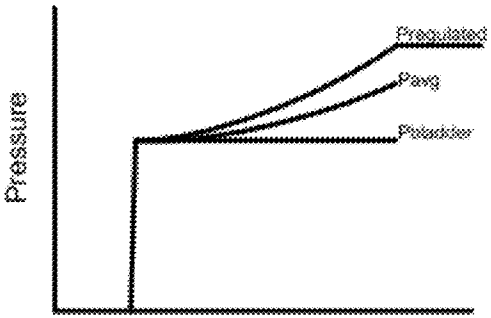

FIGS. 11A-11D provide some additional examples of screen displays that may be presented to an operator. In particular, FIGS. 11A-11D show a starting event for hydraulic system 100, i.e., from a motor shut-off to the system fully pressurized at the regulated value. FIG. 11A shows the combined effects of energizing the motor (the large rectangular surge of power) and accelerating its rotor and the pump to operating speed (the bottom part of the graph). The end of this event (typically happens when motor current reduces below nameplate current is noted by variable L52. It is 0 prior to the motor achieving running condition and 1 afterward. FIG. 11B shows the FlowRate, which holds at GPMmax until the system is pressurized and then reduces to leakage flow through valve 205. In the middle of this graph, the volume is a linear ramp consistent with a fixed flow rate. FIG. 11C shows the linear ramp of volume as the constant flow rate integrates into the accumulator reservoir. FIG. 11D illustrates plots of various pressure parameters that are monitored. The highest pressure in the graph, is the dynamic system pressure as determined in equation 20. As shown, this pressure becomes Pregulated once the accumulators are filled with oil and the pump is in equilibrium feeding the leakage flow to valve 205. Starting from zero, the pressure quickly raises against only leakage flow until the accumulators start to charge at pressure Pbladder, which is lowest of the three pressure curves. The middle curve in FIG. 11D shows the integrated average value per equations 25-27. Dividing the volume of oil in the accumulator by the total storage value V0 gives $\phi_{volume}$, which then makes it possible to determine the experimental estimate of the bladder pressure by multiplying $f(\phi_{volume})$ by the integrated average pressure, P_int.

With this information, the plant operator now has an internally consistent check for the health of the accumulator storage. In particular, the time that it takes to pressurize the system gives a reasonable estimate of the oil volume stored, V. From vendor documentation, one can also understand what the available storage, V0, should be for a particular accumulator.

Those skilled in the art will recognize that the plots of FIGS. 10A-10D and FIGS. 11A-11D are only a few examples that can be generated. Furthermore, this information may be presented to an operator located at a remote computing system where controller 155 may be deployed or to an operator located proximate hydraulic pump unit 105 and hydraulic fluid consuming device 200 via a computing device such as a portable human interface machine.

Referring back to FIGS. 9A-9E, because the process described in flow chart 900 is continuous, the process operation continues from process operation 988 to program string D which goes back to FIG. 9A at the portion after the booting of controller 155 and initialization of the various process variables.

The foregoing flow chart of FIGS. 9A-9E shows some of the processing functions associated with using controller 155 to compute various hydraulic fluid parameter computations and diagnostic. In this regard, each block represents a process act associated with performing these functions. It should also be noted that in some alternative implementations, the acts noted in the blocks may occur out of the order noted in the figures or, for example, may in fact be executed substantially concurrently or in the reverse order, depending upon the act involved. Also, one of ordinary skill in the art will recognize that additional blocks that describe the processing functions may be added.

In various embodiments of the present invention, portions of the actions performed by controller 155 can be implemented in the form of an entirely hardware embodiment, an entirely software embodiment or an embodiment containing both hardware and software elements. In one embodiment, the processing functions performed by controller 155 may be implemented in software, which includes but is not limited to firmware, resident software, microcode, etc. In one embodiment, the processing functions performed by controller 155 may be implemented in a control system such as the MARK™ VIe control system offered by GE Energy.

Furthermore, the processing functions performed by controller 155 can take the form of a computer program product accessible from a computer-usable or computer-readable medium providing program code for use by or in connection with a computer or any instruction execution system (e.g., processing units). For the purposes of this description, a computer-usable or computer readable medium can be any computer readable storage medium that can contain or store the program for use by or in connection with the computer or instruction execution system.

The computer readable medium can be an electronic, magnetic, optical, electromagnetic, infrared, or semiconductor system (or apparatus or device). Examples of a computer-readable medium include a semiconductor or solid state memory, a random access memory (RAM), a read-only memory (ROM), a rigid magnetic disk and an optical disk. Current examples of optical disks include a compact disk-read only memory (CD-ROM), a compact disk-read/write (CD-R/W) and a digital video disc (DVD).

While the disclosure has been particularly shown and described in conjunction with a preferred embodiment thereof, it will be appreciated that variations and modifications will occur to those skilled in the art. Therefore, it is to be understood that the appended claims are intended to cover all such modifications and changes as fall within the true spirit of the disclosure.

What is claimed is:

1. A system, comprising:

a hydraulic fluid consuming device;

a hydraulic pump unit that provides hydraulic fluid to the hydraulic fluid consuming device, the hydraulic pump unit including a pump unit and at least one accumulator that are configured to deliver the hydraulic fluid to the hydraulic fluid consuming device;

a wattmeter that measures the electric power consumption by the hydraulic pump unit during a transient-state start-up operation in which the hydraulic pump unit turns on to deliver the hydraulic fluid to the hydraulic fluid consuming device and thereafter replenish the accumulator for a predetermined amount of time; and a controller that uses the electric power consumption measured by the wattmeter during the transient-state start-up operation to determine fluid flow parameters from the operation of the pump unit and the at least one accumulator, wherein the fluid flow parameters comprise power delivered to the hydraulic fluid by the hydraulic pump unit and volumetric flow rates, the controller determining the power delivered to the hydraulic fluid by the hydraulic pump unit by reference to power consumption that occurs above a minimum trigger power level, the minimum trigger power level representing a minimum power difference above a floor power level that represents the transient-state start-up operation and which indicates that the hydraulic fluid consuming device is starting to consume hydraulic fluid, wherein the controller determines a plurality of diagnostics for the hydraulic fluid consuming device and the hydraulic pump unit as a function of the fluid flow parameters, including estimating an internal pressure and hydraulic storage amount of the at least one accumulator using a polytropic gas relationship and the predetermined amount of time, respectively, which estimate the at least one accumulator's condition relative to an initial internal pressure and available hydraulic fluid storage amount of the at least one accumulator.

2. The system according to claim 1, wherein the transient-state start-up operation comprises the hydraulic fluid consuming device making a demand for hydraulic fluid, the demand for hydraulic fluid causing a pressure drop in the hydraulic pump unit, the pump unit and the at least one accumulator responding to the pressure drop by delivering the hydraulic fluid to the hydraulic fluid consuming device, the at least one accumulator delivering the hydraulic fluid until the demand for hydraulic fluid by the hydraulic fluid consuming device has been satisfied, the pump unit continuing operation after the demand for hydraulic fluid by the hydraulic fluid consuming device has been satisfied by replenishing the at least one accumulator, and the pump unit turning off upon the at least one accumulator being replenished.

3. The system according to claim 1, wherein the transient-state start-up operation comprises stroking the hydraulic fluid consuming device from a closed position where the delivery of hydraulic fluid is inhibited to an open position where a substantial amount of hydraulic fluid is provided thereto, and back to the closed position where the delivery of hydraulic fluid to the hydraulic fluid consuming device is inhibited.

4. The system according to claim 3, wherein one of the plurality of diagnostics comprises determining an amount of hydraulic fluid displaced during the stroking of the hydraulic fluid consuming device.

5. The system according to claim 4, wherein the condition of the at least one accumulator includes an operational health of the at least one accumulator that is compared against subsequent measurements of displaced hydraulic fluid obtained from future strokings of the hydraulic fluid consuming device.

6. The system according to claim 3, wherein one of the plurality of diagnostics comprises generating at least one plot of waveforms describing operational effects while performing the stroking of the hydraulic fluid consuming device.

7. The system according to claim 3, wherein one of the plurality of diagnostics comprises determining slew time to perform the stroking of the hydraulic fluid consuming device.

8. The system according to claim 1, wherein the controller is integrated with a portable human interface machine device that operates in proximity to the hydraulic pump unit and the hydraulic fluid consuming device, wherein the portable human interface machine is configured to initiate the transient-state start-up operation and determine the plurality of diagnostics for the hydraulic fluid consuming device and the hydraulic pump unit.

9. The system according to claim 1, wherein the controller is integrated with a remote computing system that facilitates remote monitoring and diagnostics of the hydraulic pump unit and the hydraulic fluid consuming device during the transient-state start-up operation.

10. The system according to claim 1, wherein the volumetric flow rates include a volumetric flow rate of the hydraulic fluid delivered to the hydraulic fluid consuming device by the hydraulic pump unit.

11. A hydraulic system, comprising:

a plurality of hydraulic fluid consuming devices;

an electric motor;

a pump unit driven by the electric motor that provides hydraulic fluid to the plurality of hydraulic fluid consuming devices, the pump unit further including at least one accumulator used to contribute in delivering the hydraulic fluid to the hydraulic fluid consuming devices;

a valve that controls supply of the hydraulic fluid by the pump unit and the at least one accumulator to the plurality of hydraulic fluid consuming devices;

a wattmeter that measures the electric power consumption by the electric motor as the pump unit and the at least one accumulator provide the hydraulic fluid to the plurality of hydraulic fluid consuming devices during a transient-state start-up operation in which the pump unit and the at least one accumulator turn on to deliver the hydraulic fluid to the plurality of hydraulic fluid consuming devices and thereafter replenish the accumulator for a predetermined amount of time; and a controller that uses the electric power consumption measured by the wattmeter during the transient-state start-up operation to determine fluid flow parameters from the operation of the pump unit and the at the least one accumulator, wherein the fluid flow parameters comprise power delivered to the hydraulic fluid by the hydraulic pump unit and volumetric flow rates, the controller determining the power delivered to the hydraulic fluid by the hydraulic pump unit by reference to power consumption that occurs above a minimum trigger power level, the minimum trigger power level representing a minimum power difference above a floor power level that represents the transient-state start-up operation and which indicates that the hydraulic fluid consuming device is starting to consume hydraulic fluid, the controller determines a plurality of diagnostics for the hydraulic fluid consuming device and the pump unit as a function of the fluid flow parameters, including estimating an internal pressure and hydraulic storage amount of the at least one accumulator using a polytropic gas relationship and the predetermined amount of time, respectively, which estimate the at least one accumulator's condition relative to an initial internal pressure and available hydraulic fluid storage amount of the at least one accumulator.

12. The hydraulic system according to claim 11, wherein the transient-state start-up operation comprises at least one of the plurality of hydraulic fluid consuming devices making a demand for hydraulic fluid, the demand for hydraulic fluid causing a pressure drop, the pump unit and the at least one accumulator responding to the pressure drop by delivering the hydraulic fluid to the hydraulic fluid consuming device, the at least one accumulator delivering the hydraulic fluid until the demand for hydraulic fluid by the hydraulic fluid consuming device has been satisfied, the pump unit continues operation after the demand for hydraulic fluid by the hydraulic fluid consuming device has been satisfied by replenishing the at least one accumulator, and the pump unit turning off upon the at least one accumulator being replenished.

13. The hydraulic system according to claim 12, wherein the transient-state start-up operation comprises stroking the plurality of hydraulic fluid consuming devices from a closed position where the delivery of hydraulic fluid is inhibited to an open position where a substantial amount of hydraulic fluid is provided thereto, and back to the closed position where the delivery of hydraulic fluid to the hydraulic fluid consuming devices is inhibited.

14. The hydraulic system according to claim 13, wherein one of the plurality of diagnostics comprises determining an amount of hydraulic fluid displaced during the stroking of the plurality of hydraulic fluid consuming devices.

15. The hydraulic system according to claim 14, wherein the condition of the at least one accumulator includes an operational health of the at least one accumulator that is compared against subsequent measurements of displaced hydraulic fluid obtained from future stroking of the plurality of hydraulic fluid consuming devices.

16. The hydraulic system according to claim 13, wherein one of the plurality of diagnostics comprises generating at least one plot of waveforms describing operational effects while performing the stroking of the plurality of hydraulic fluid consuming devices.

17. The hydraulic system according to claim 13, wherein one of the plurality of diagnostics comprises determining slew time to perform the stroking of the plurality of hydraulic fluid consuming devices.

18. The hydraulic system according to claim 13, wherein the stroking of the plurality of hydraulic fluid consuming devices comprises stroking each of the hydraulic fluid consuming devices individually, stroking a pair of the hydraulic fluid consuming devices after individual device stroking, stroking a trio of the hydraulic fluid consuming devices after stroking the pair of devices, and progressively increasing the amount hydraulic fluid consuming devices that are stroked until all of the devices have stroked together.

19. The hydraulic system according to claim 18, wherein the plurality of diagnostics are generated after each stroking set.

20. The hydraulic system according to claim 19, wherein one of the plurality of diagnostics comprises an amount of energy used by the at least one accumulator during each stroking set.

21. The hydraulic system according to claim 19, wherein one of the plurality of diagnostics comprises determining an amount of hydraulic fluid displaced during each stroking set.

22. The hydraulic system according to claim 19, wherein one of the plurality of diagnostics comprises generating at least one plot of waveforms describing operational effects while performing each stroking set.

23. The hydraulic system according to claim 19, wherein one of the plurality of diagnostics comprises determining slew time to perform the stroking of the plurality of hydraulic fluid consuming devices in each stroking set.

24. The hydraulic system according to claim 18, wherein the plurality of diagnostics includes an operational health of the plurality of hydraulic fluid consuming devices, the electric motor and the pump unit.

* * * * *